US011223159B2

(12) United States Patent
Lee

(10) Patent No.: US 11,223,159 B2
(45) Date of Patent: Jan. 11, 2022

(54) SAFETY OUTLET

(71) Applicant: Jong Ho Lee, Changwon-si (KR)

(72) Inventor: Jong Ho Lee, Changwon-si (KR)

( * ) Notice: Subject to any disclaimer, the term of this patent is extended or adjusted under 35 U.S.C. 154(b) by 20 days.

(21) Appl. No.: 16/674,228

(22) Filed: Nov. 5, 2019

(65) Prior Publication Data

US 2020/0144763 A1 May 7, 2020

(30) Foreign Application Priority Data

Nov. 6, 2018 (KR) ..... 10-2018-0135188
Oct. 18, 2019 (KR) ..... 10-2019-0129556

(51) Int. Cl.

| | |
|---|---|
| ***H01R 13/52*** | (2006.01) |
| ***H01R 33/965*** | (2006.01) |
| ***H01R 13/18*** | (2006.01) |
| ***H01R 13/10*** | (2006.01) |

(52) U.S. Cl.

CPC ..... *H01R 13/5219* (2013.01); *H01R 13/10* (2013.01); *H01R 13/18* (2013.01); *H01R 33/965* (2013.01)

(58) Field of Classification Search

CPC .. H01R 13/703; H01R 24/78; H01R 13/7037; H01R 13/7033

See application file for complete search history.

(56) References Cited

U.S. PATENT DOCUMENTS

2005/0194322 A1* 9/2005 Palmer ..... B01D 21/2444 210/715
2008/0289693 A1* 11/2008 Irwin ..... F16K 31/402 137/12

FOREIGN PATENT DOCUMENTS

| | | | |
|---|---|---|---|
| KR | 20-0340351 | Y1 | 2/2004 |
| KR | 10-2005-0113133 | A | 12/2005 |
| KR | 10 2005 0113133 | A | 12/2005 |
| KR | 10-2010-0013067 | A | 2/2010 |
| KR | 10 2010 0013067 | A | 2/2010 |
| KR | 101062296 | B1 | 9/2011 |
| KR | 10-2016-0024739 | A | 3/2016 |
| KR | 10-1990113 | B1 | 6/2019 |
| WO | 01-082417 | A1 | 11/2001 |

OTHER PUBLICATIONS

ISR for International Application No. PCT/KR2019/014927.
KR 20-0340351 Y1 _ English Abstract.
KR 10-2005-0113133 A _ English Abstract.
KR 10-2010-0013067 A _ English Abstract.
KR 10-2016-0024739 A _ English Abstract.
KR 10-1990113 B1 _ English Abstract.
Notice of Allowance issued for the corresponding Korean Patent Application No. 10-2018-0135188 and English Translation thereof.

* cited by examiner

*Primary Examiner* — Jean F Duverne
(74) *Attorney, Agent, or Firm* — Ladas & Parry LLP

(57) ABSTRACT

Disclosed herein is a safety outlet. The safety outlet includes a casing having at least one hole into which a pin of a plug is inserted; and at least one drain pipe forming a drain channel for independently communicating the at least one hole and the outside of the casing; wherein the drain channel provided in the at least one drain pipe each serves as drain passage separated from each other, and the drain pipe is partitioned so as to maintain sealing between inside of the casing and the drain channel, wherein a contact portion connected to a power terminal arranged outside of the at least one drain pipe is provided in the at least one drain pipe.

19 Claims, 27 Drawing Sheets

【FIG. 1】
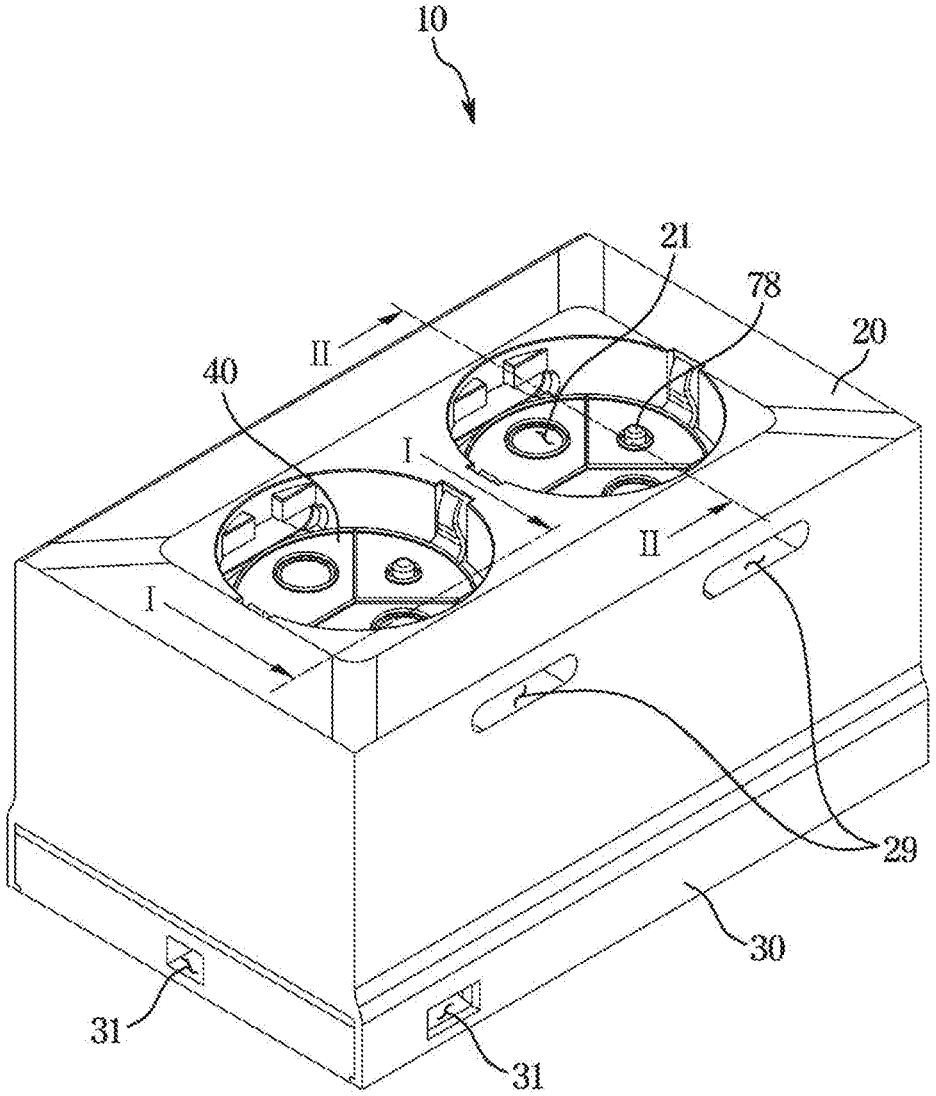

【FIG. 2】
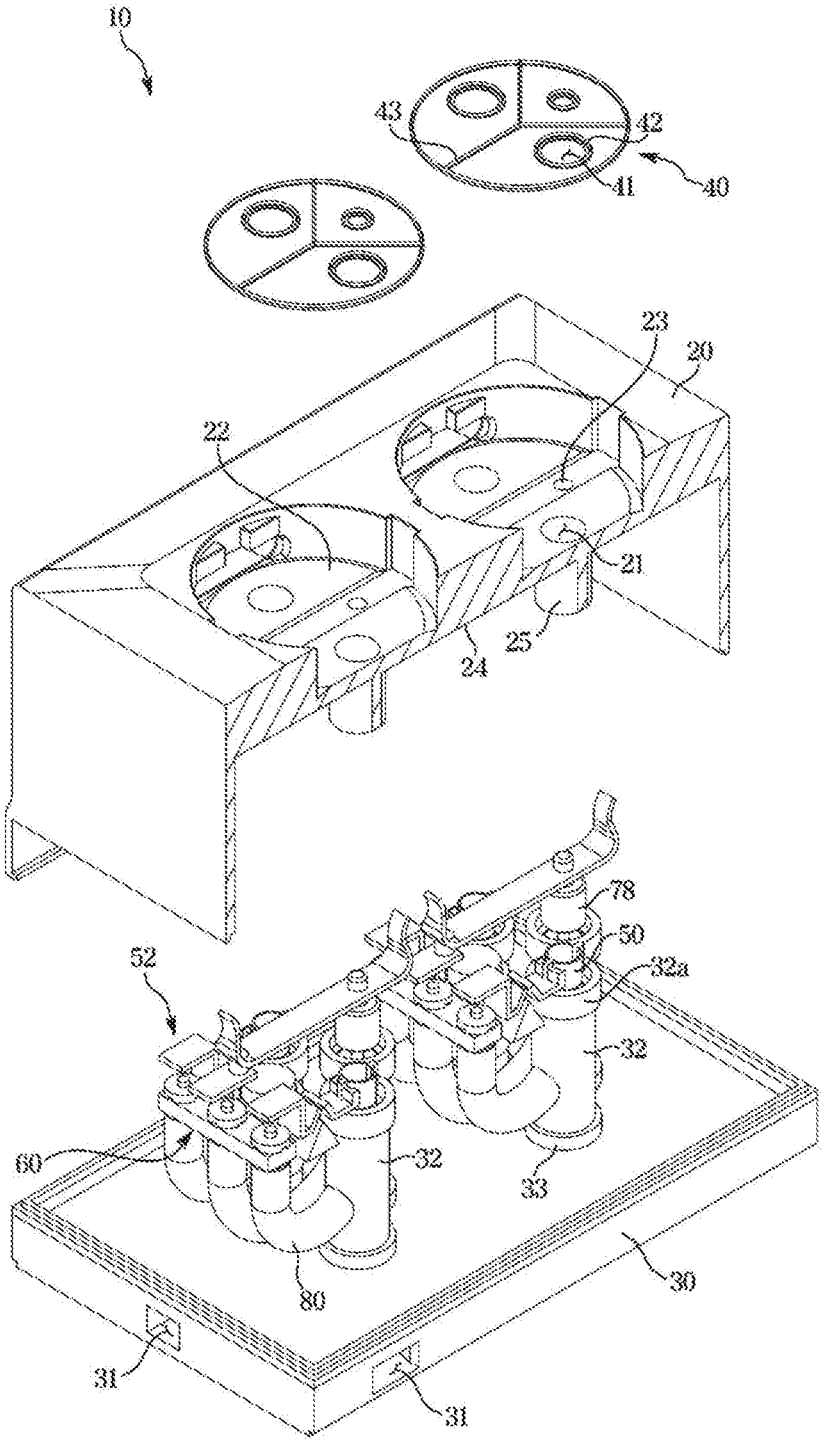

【FIG. 3】
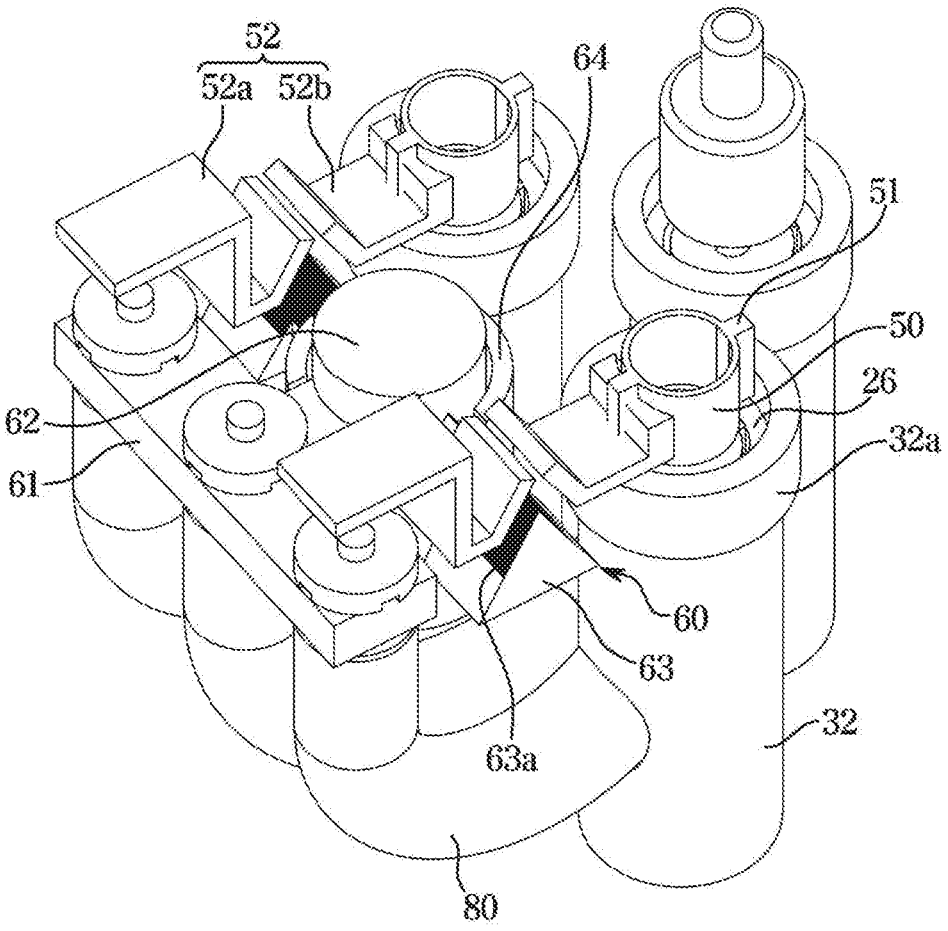

【FIG. 4】
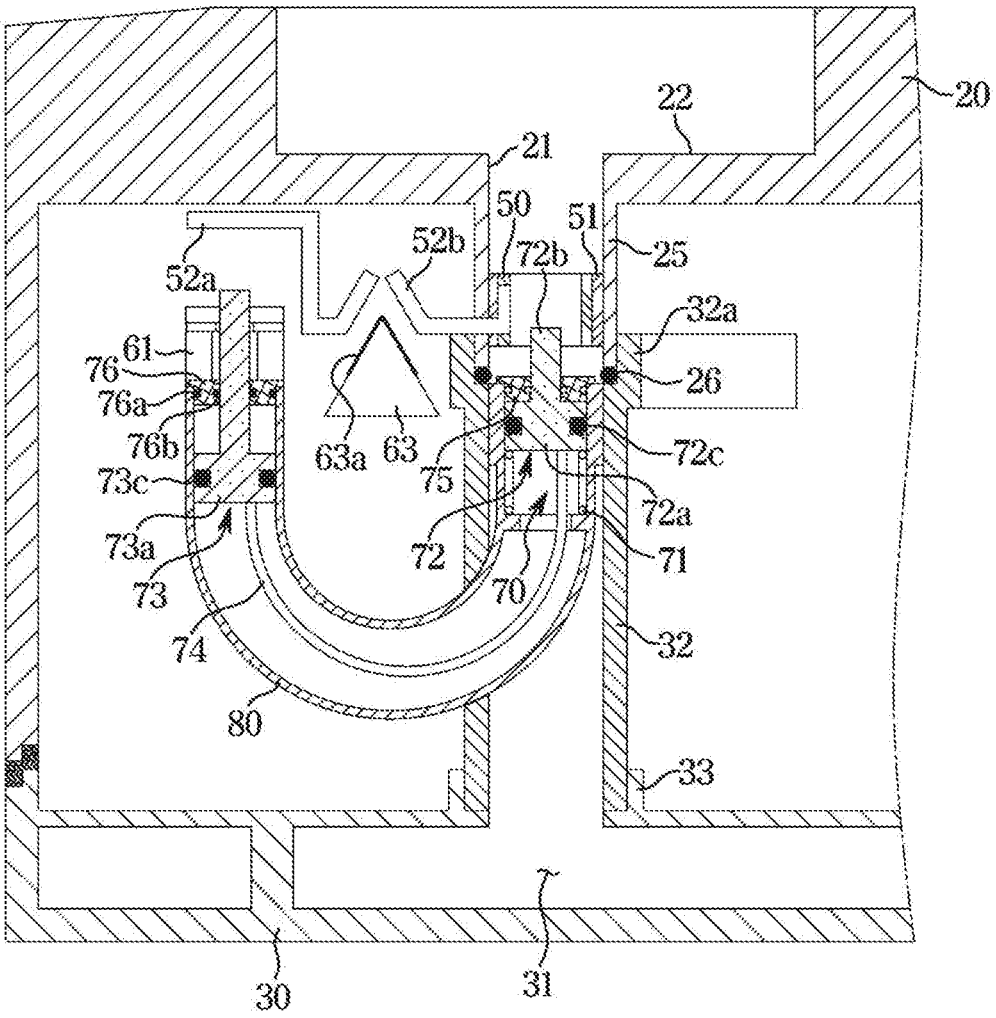

【FIG. 5】
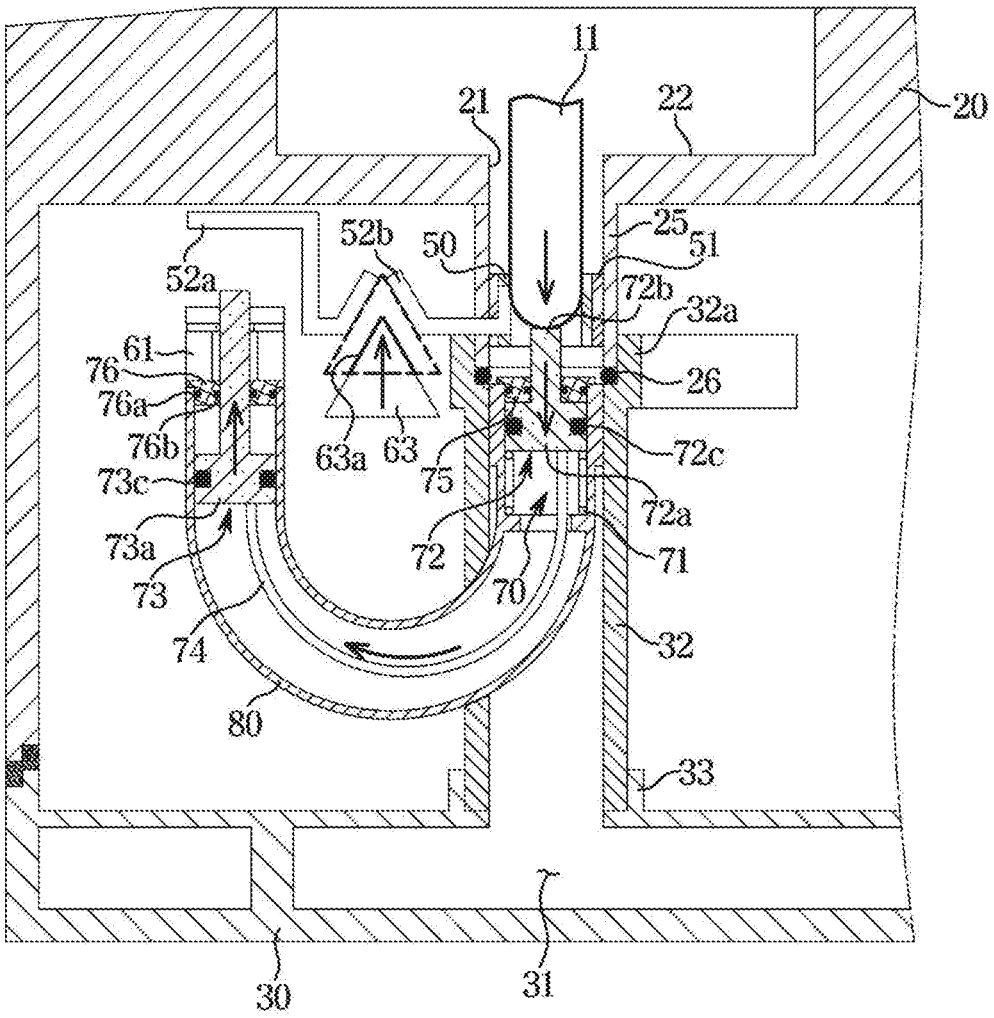

【FIG. 6】
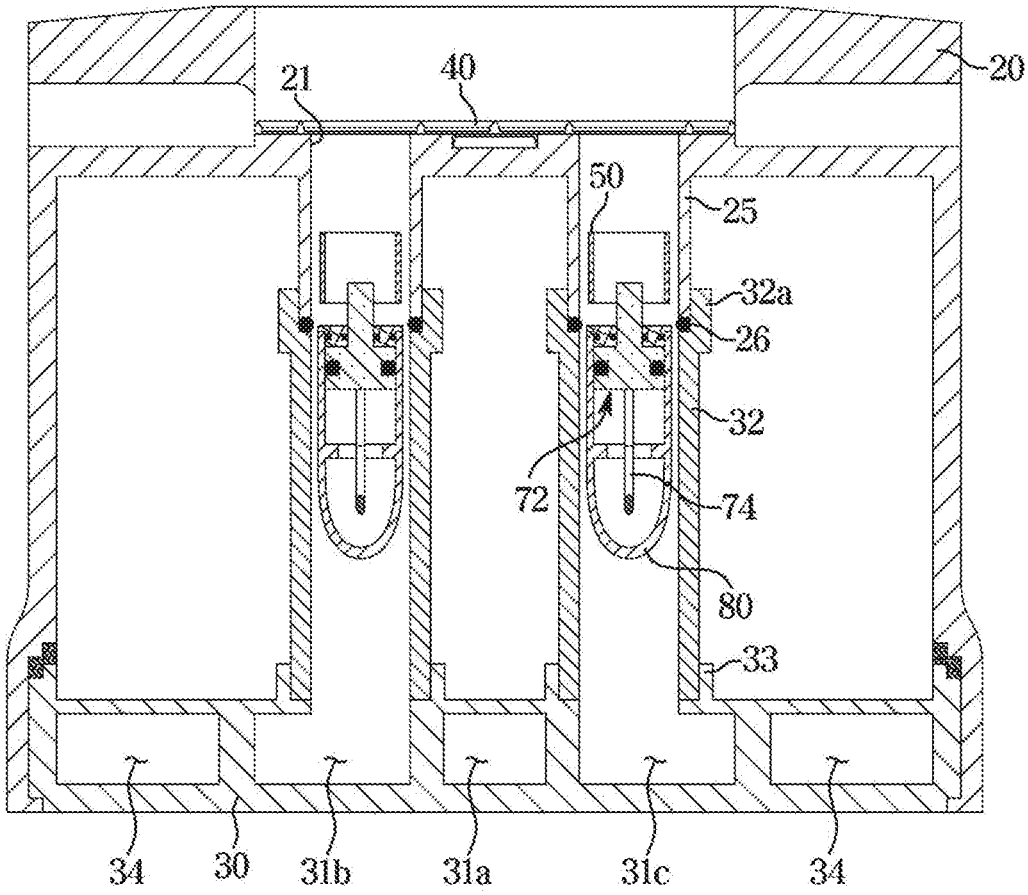

【FIG. 7】
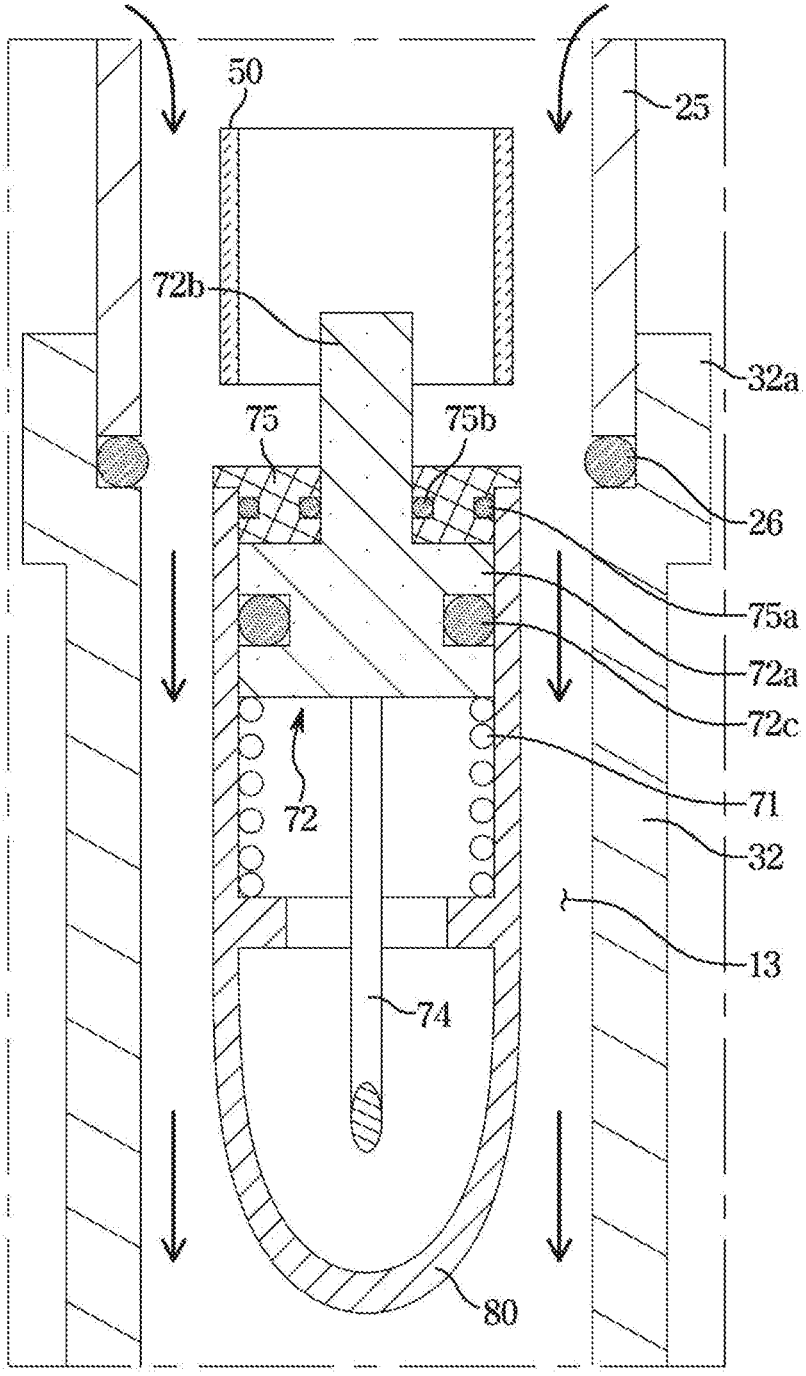

【FIG. 8】
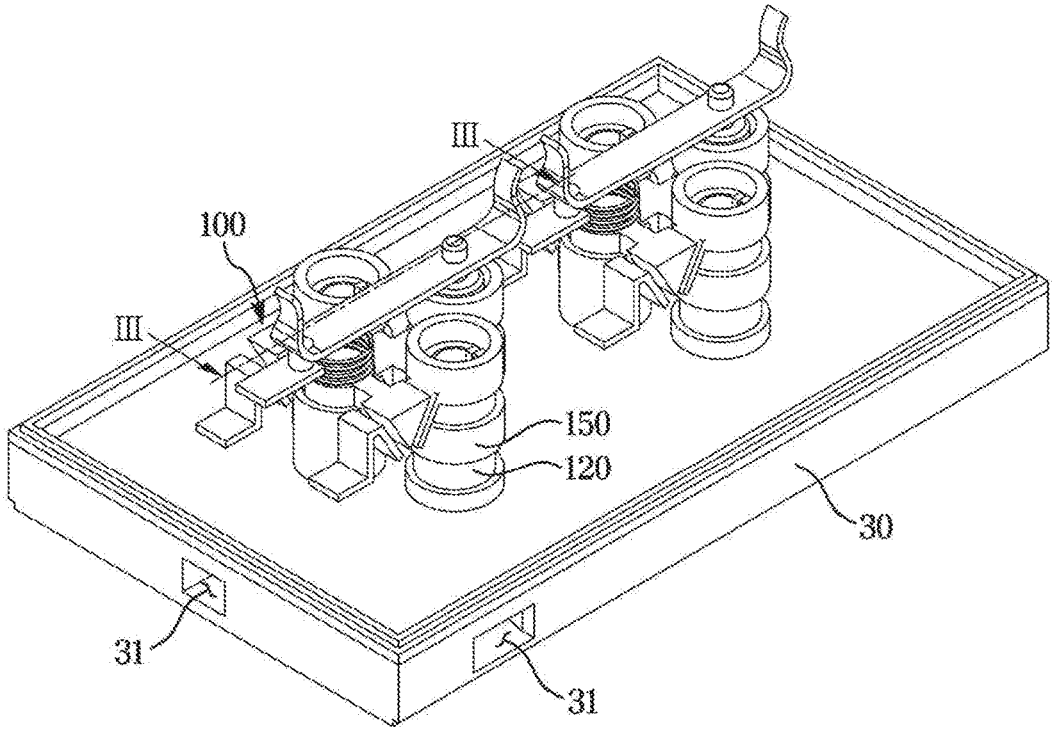

【FIG. 9】
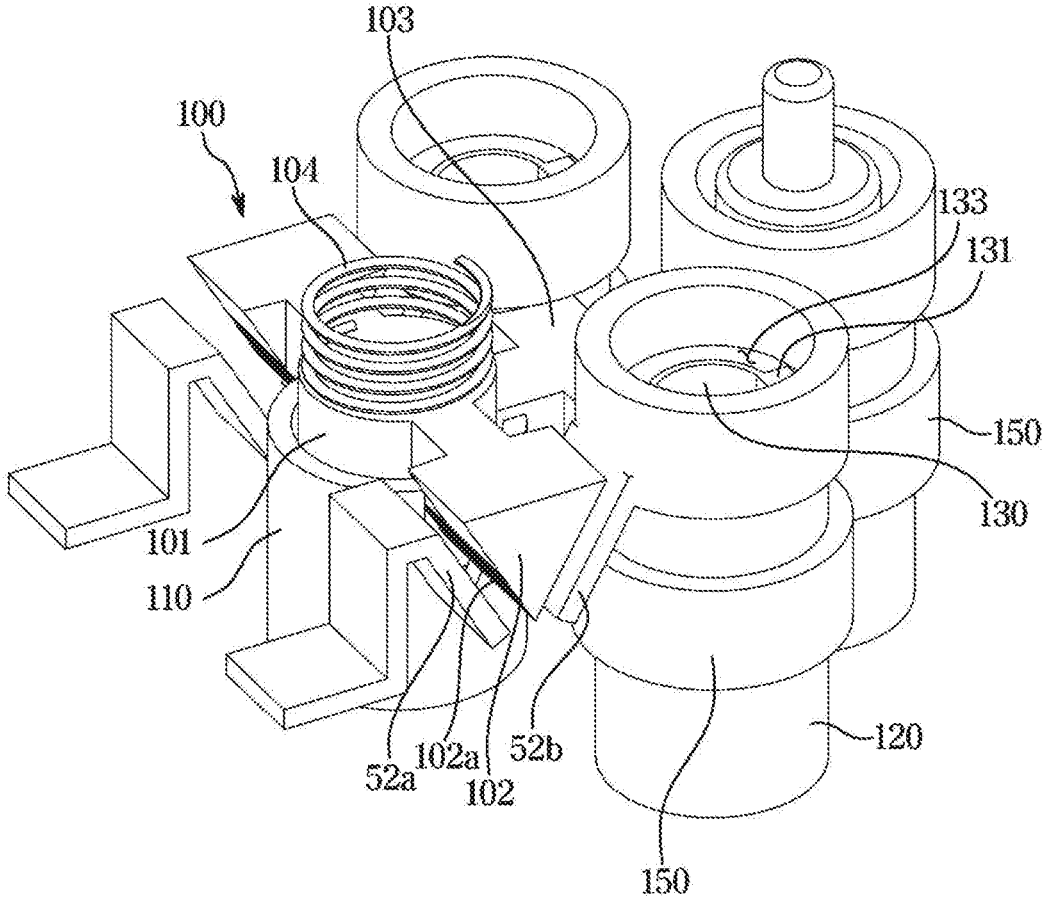

【FIG. 10】
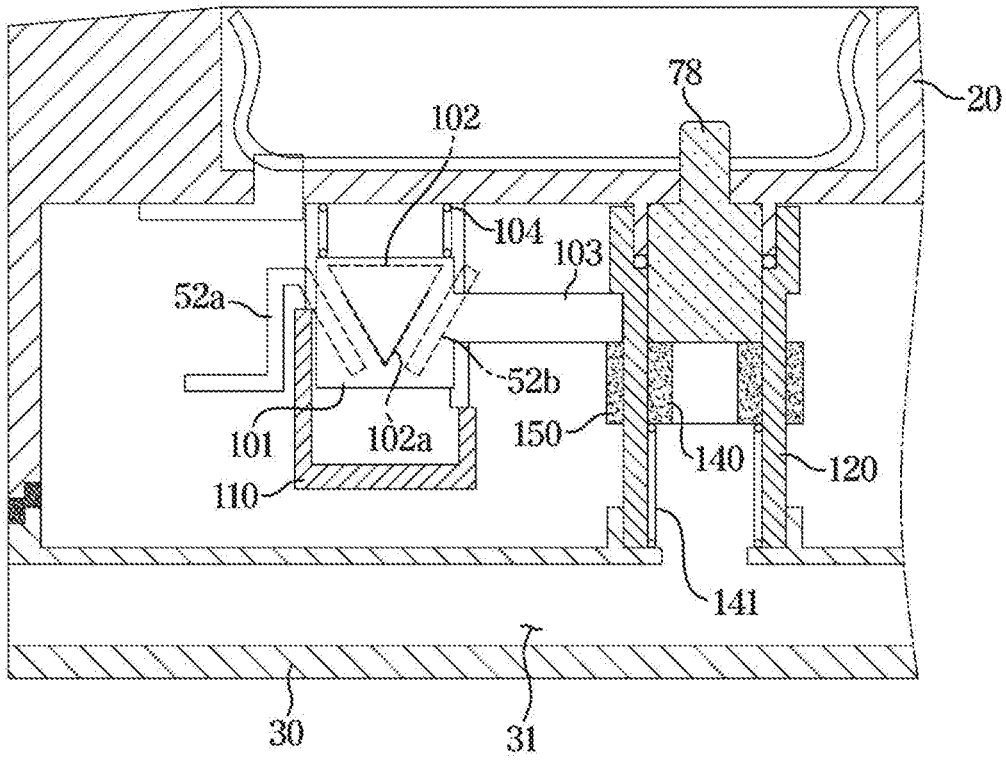

【FIG. 11】
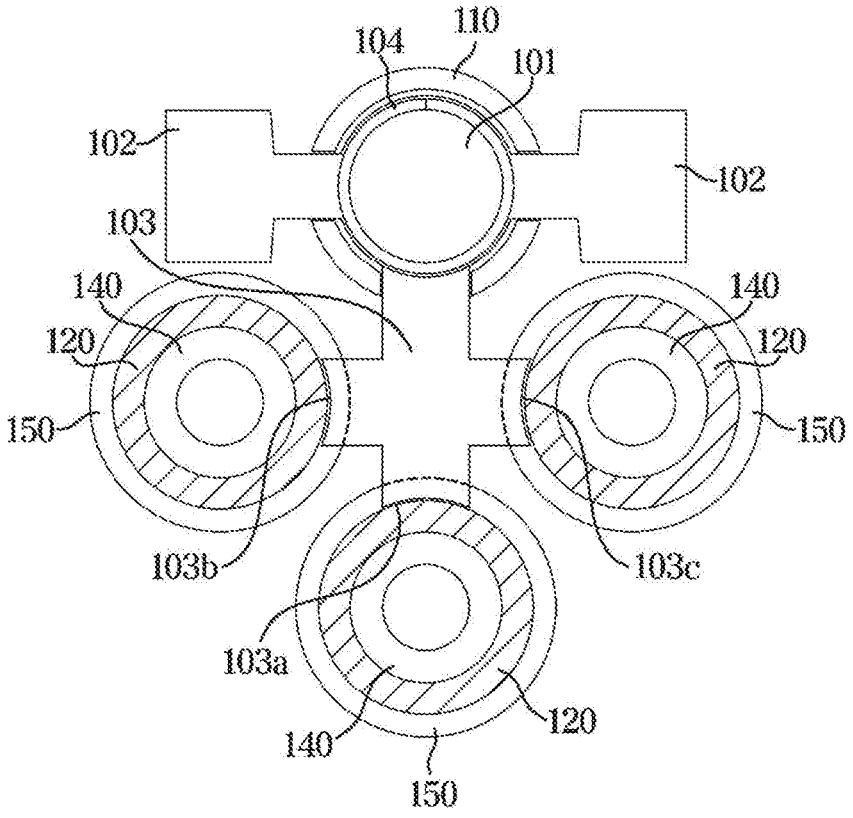

【FIG. 12】
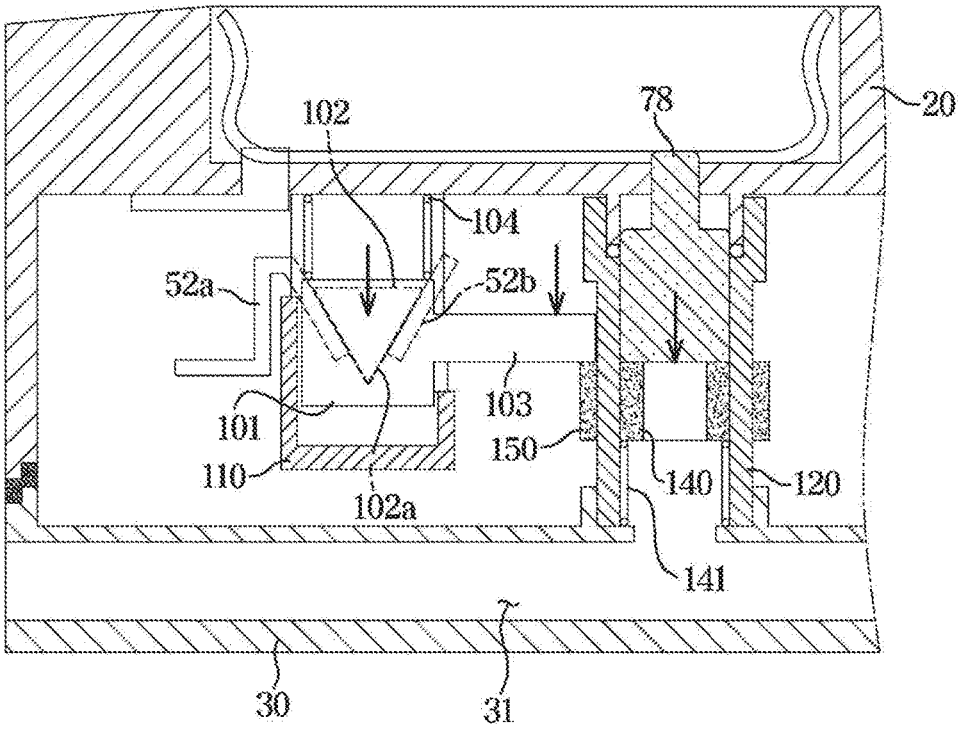
【FIG. 13】
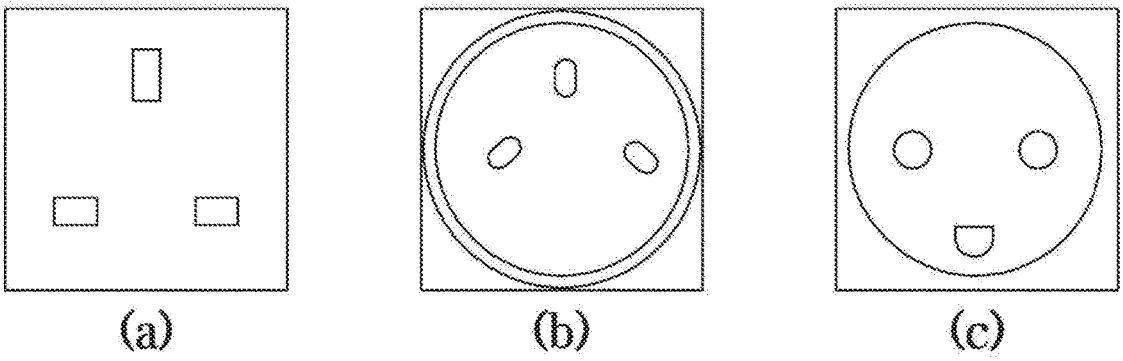

【FIG. 14】
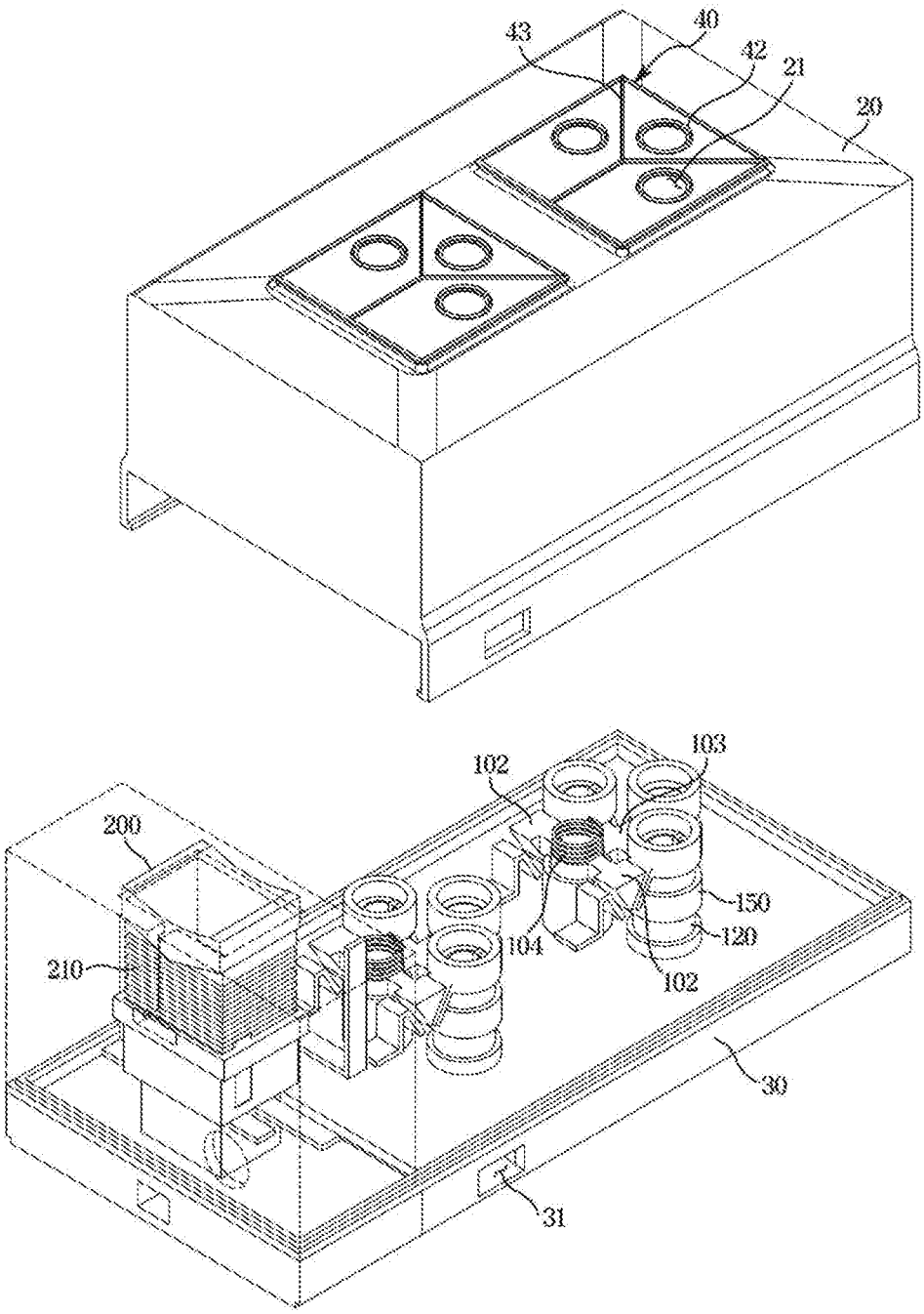

【FIG. 15】
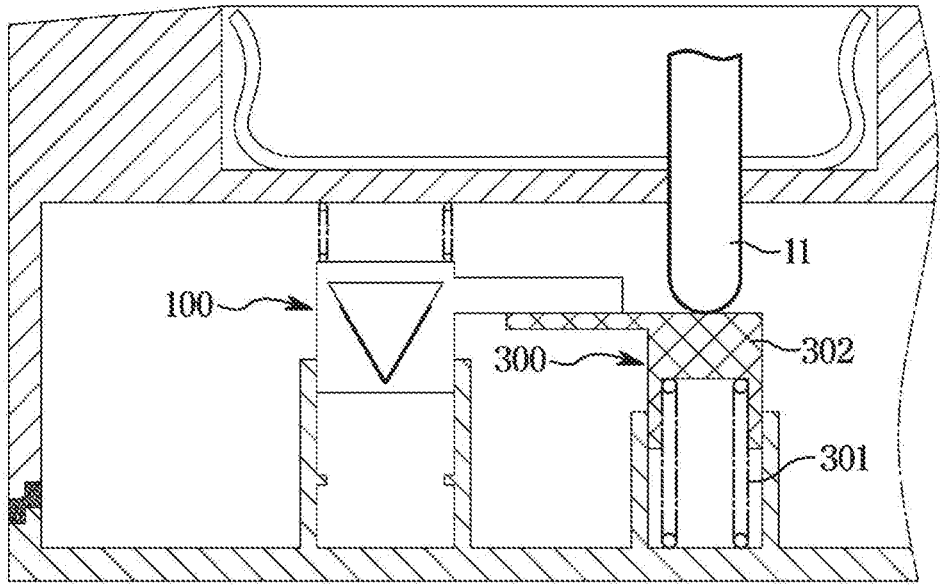

【FIG. 16】
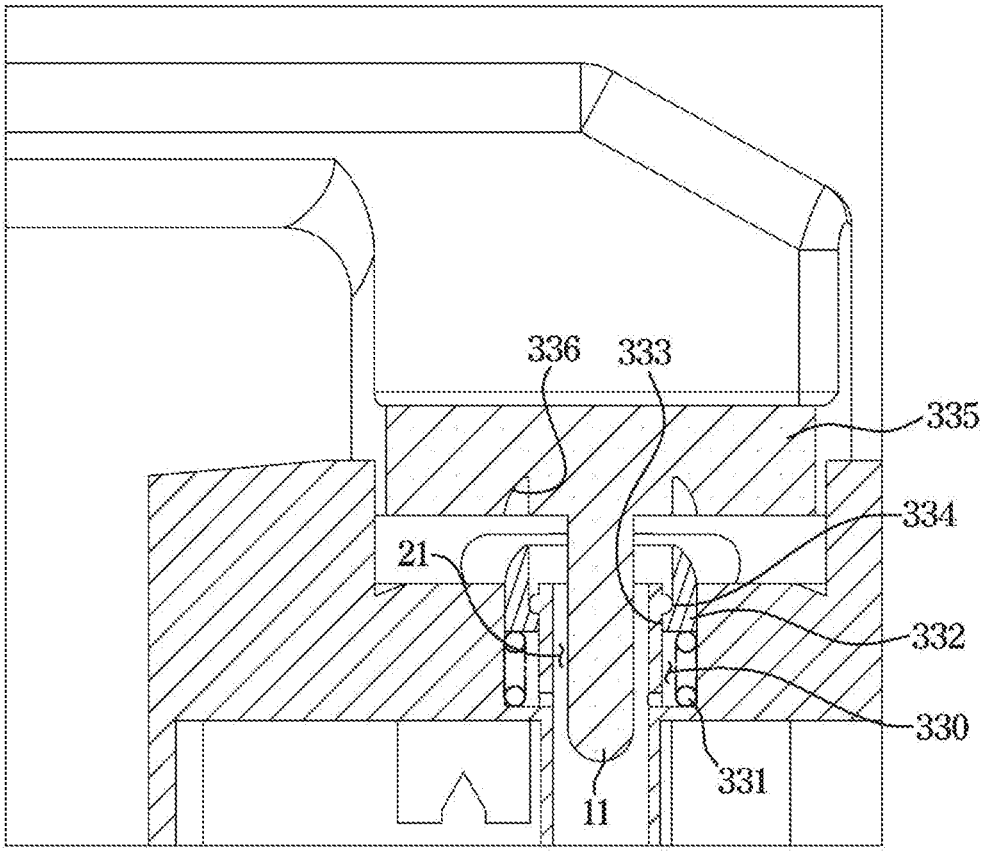

【FIG. 17】
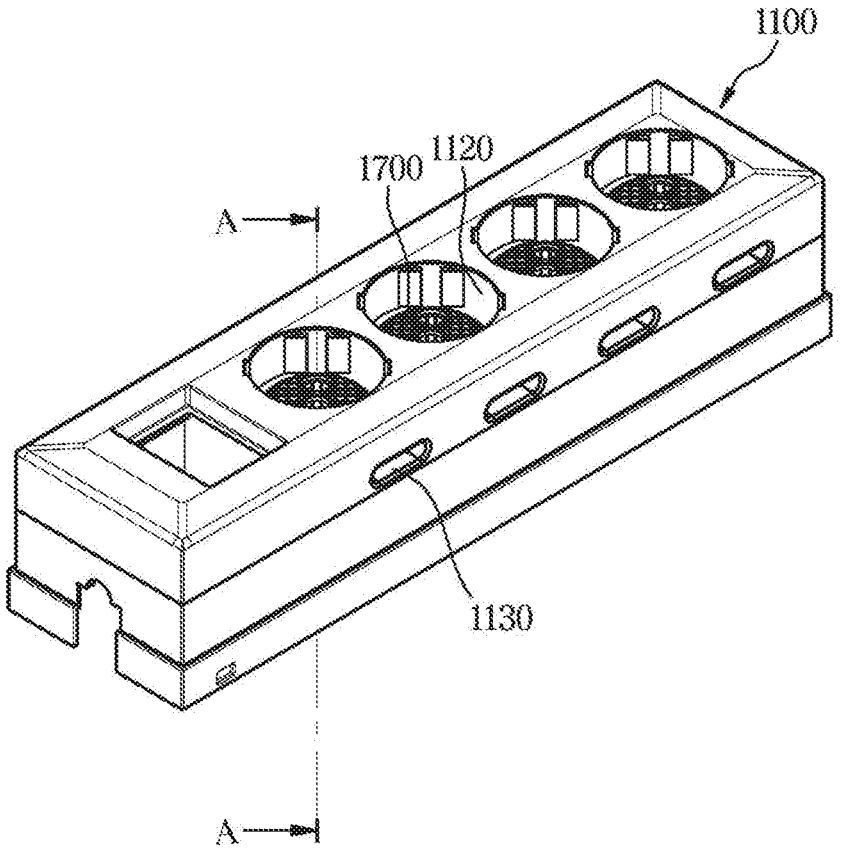

【FIG. 18】
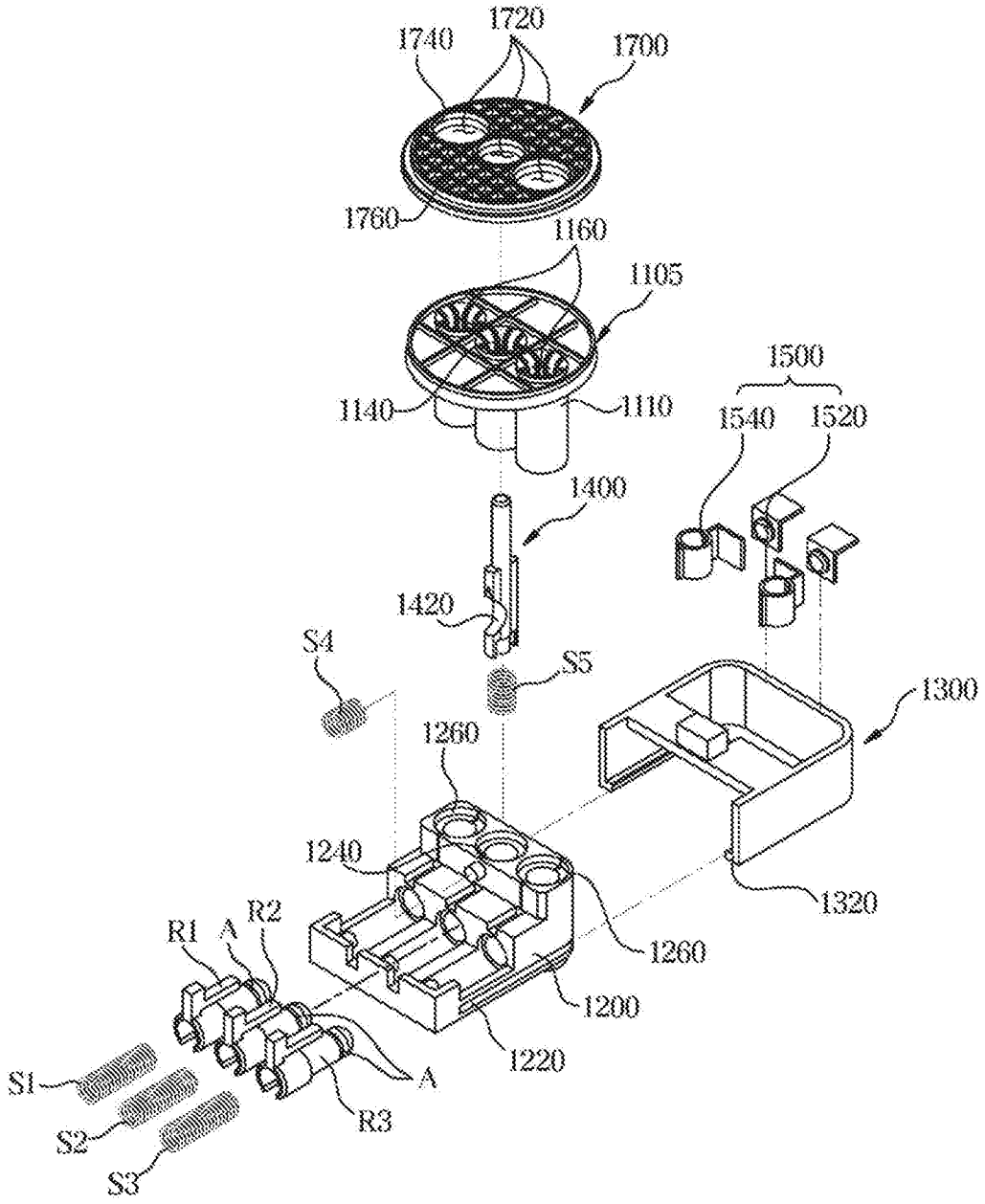

【FIG. 19】
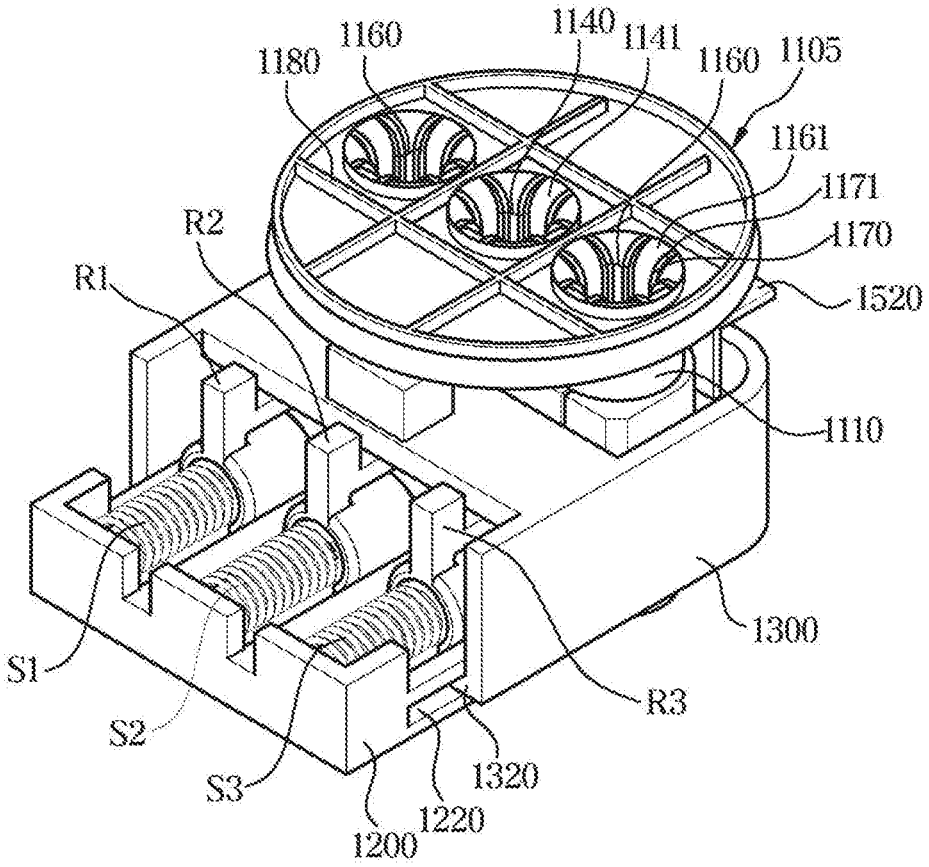

【FIG. 20】
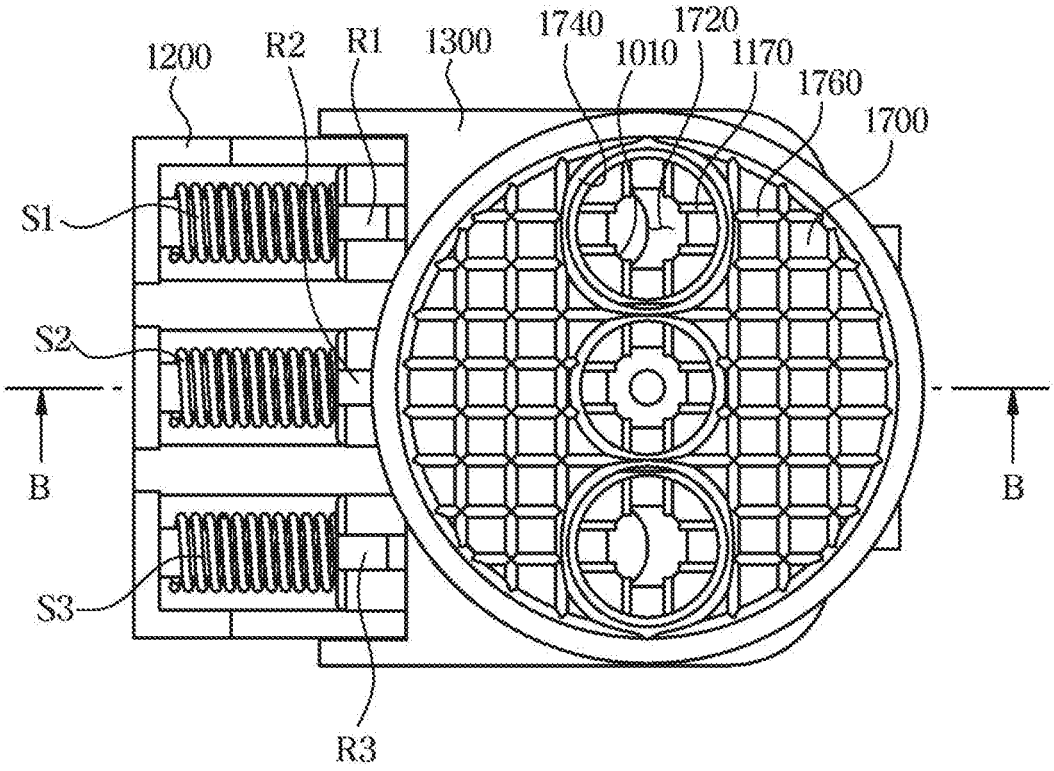

【FIG. 21】
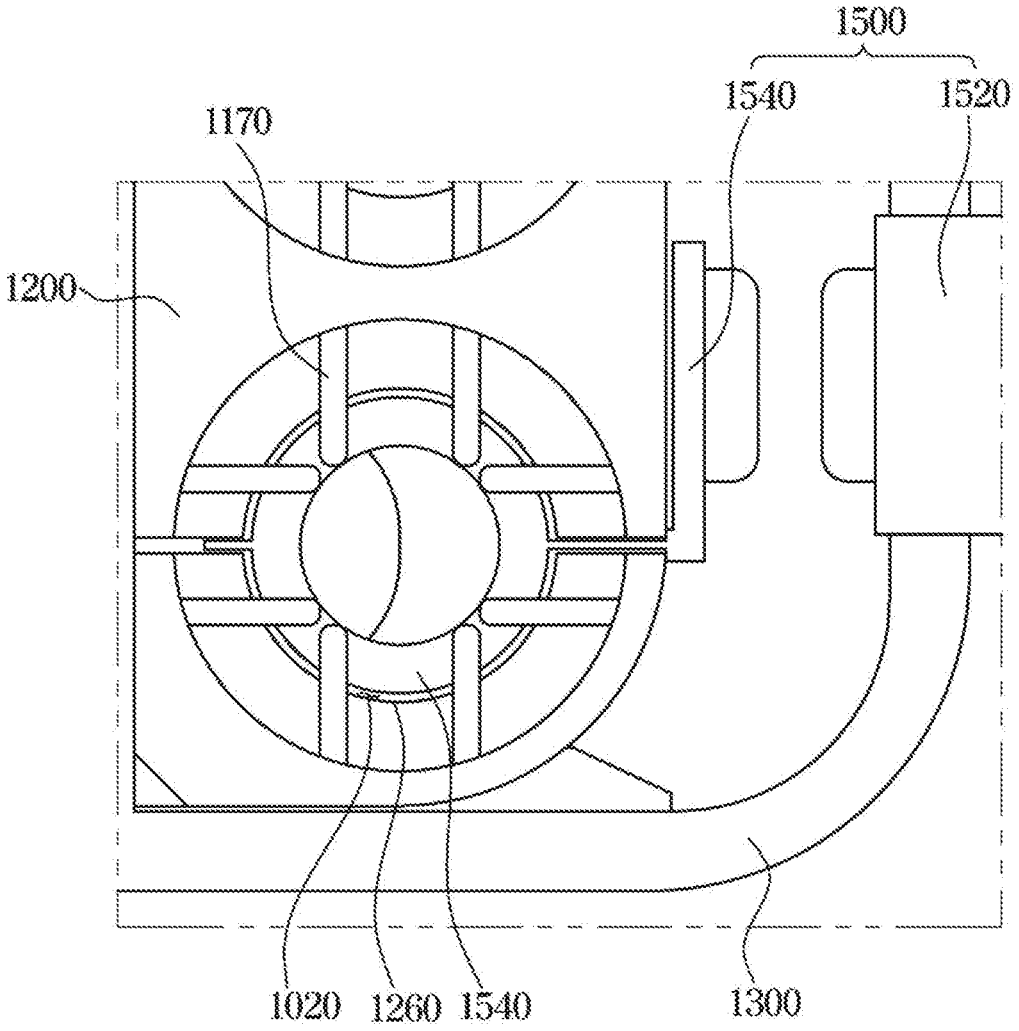

【FIG. 22】
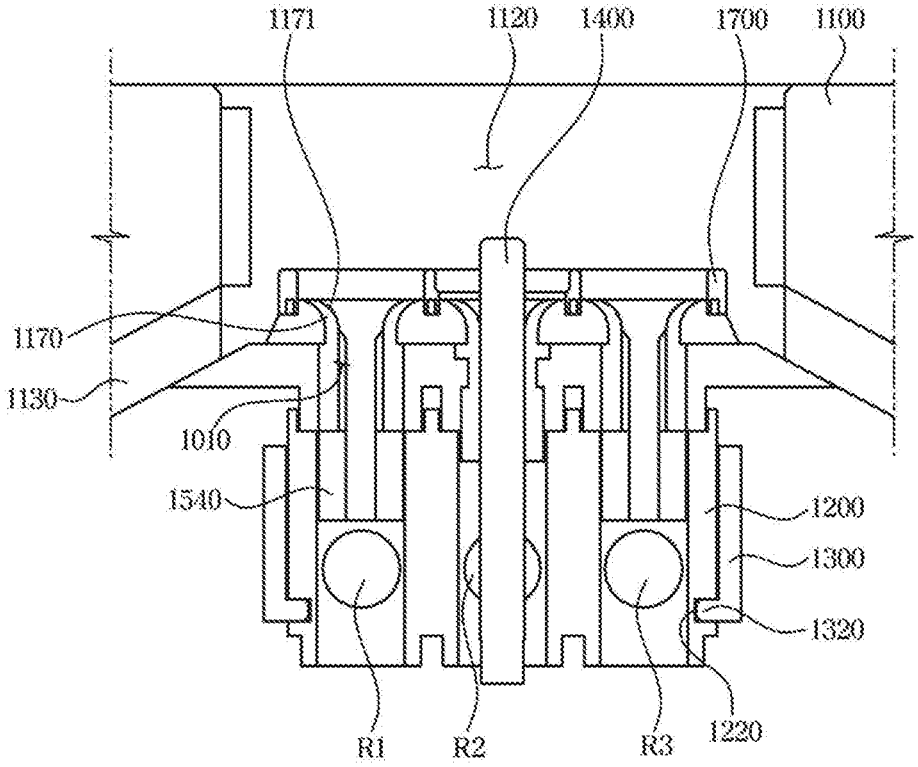

【FIG. 23】
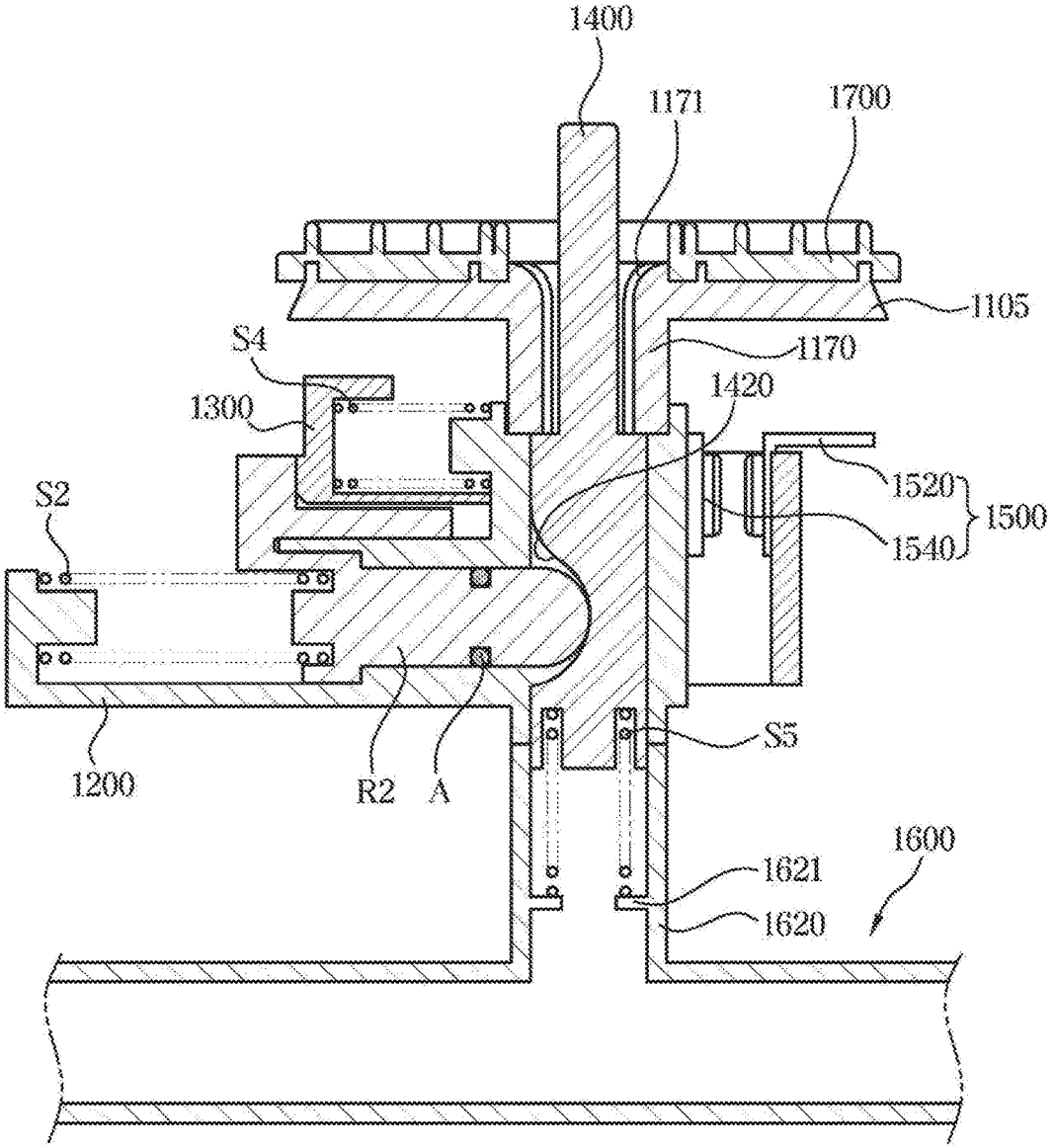

【FIG. 24】
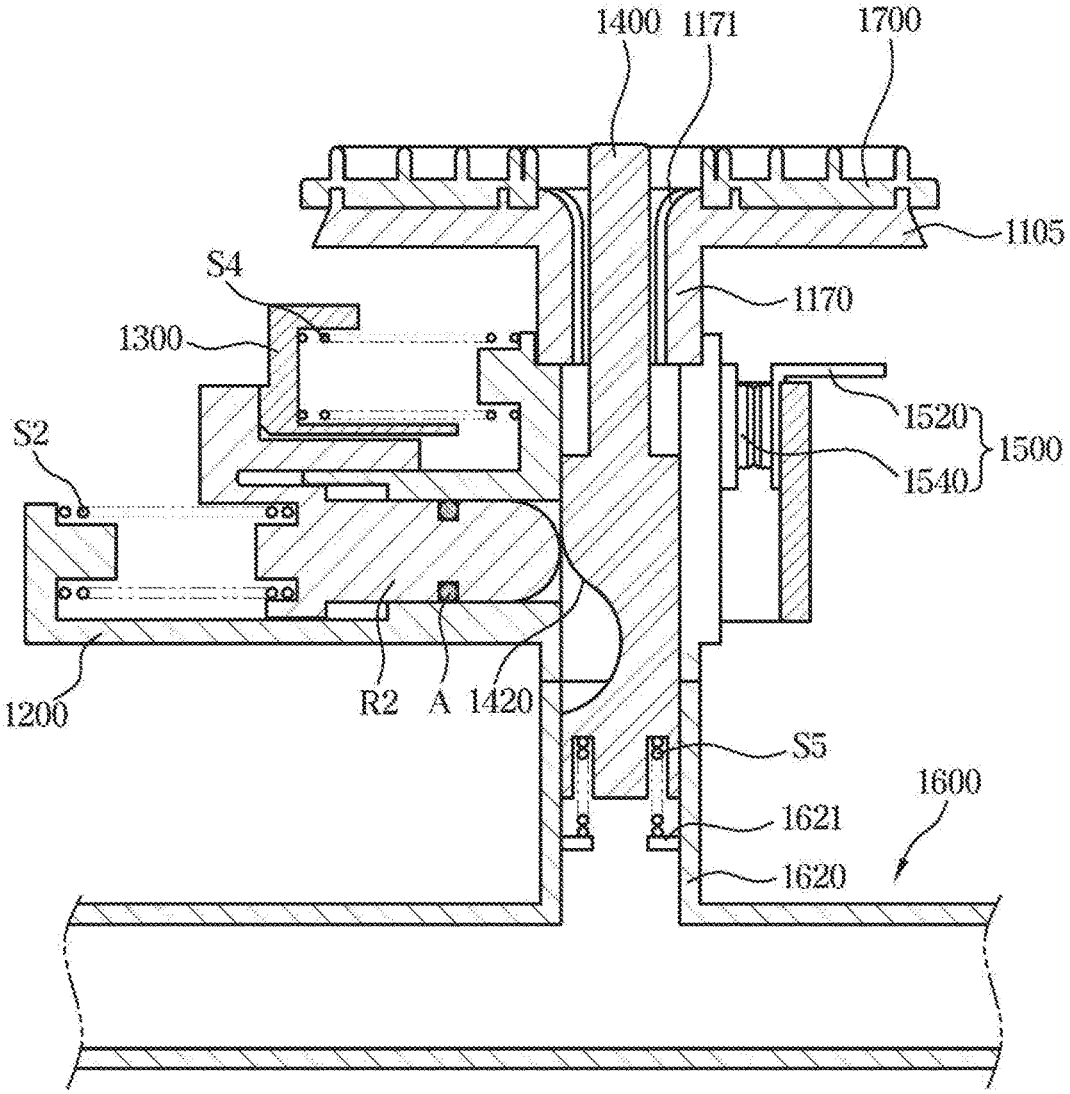

【FIG. 25】
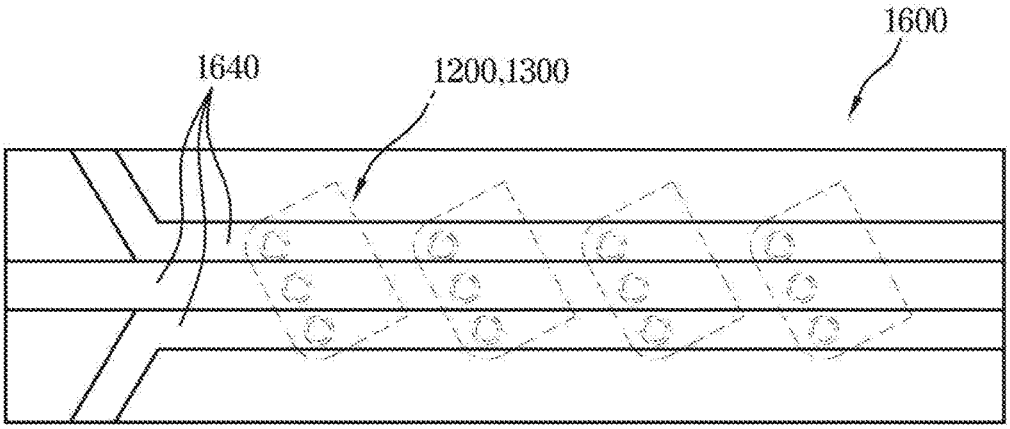
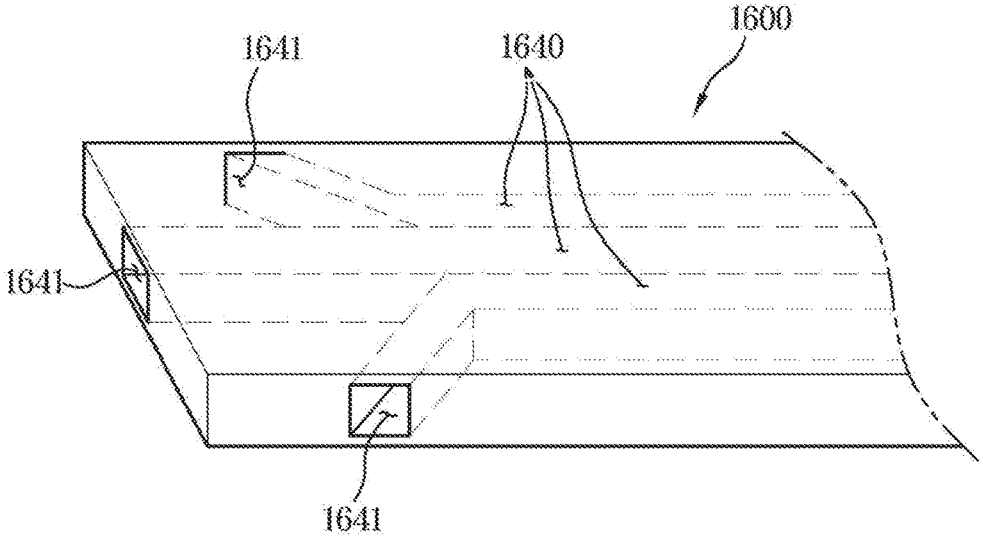

【FIG. 26】
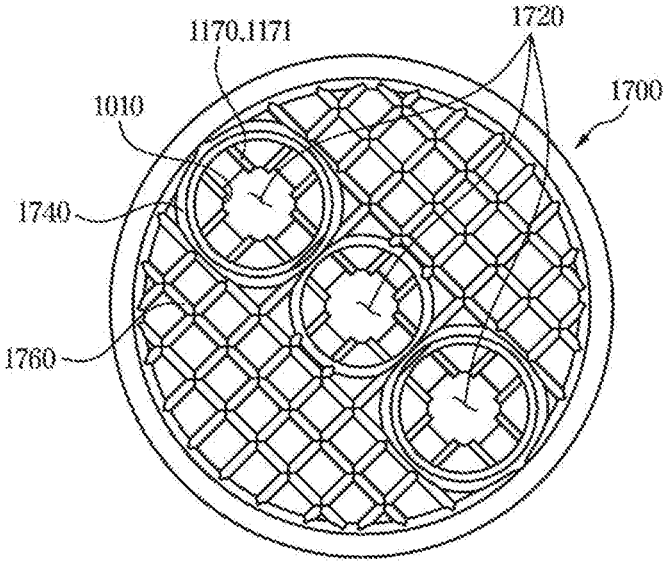
( a )
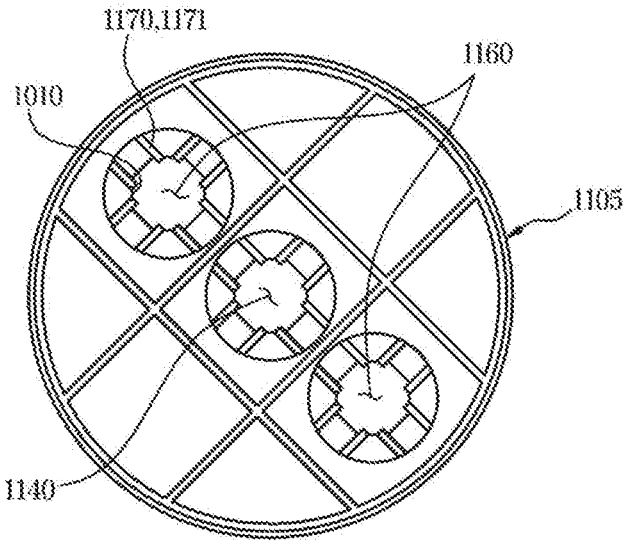
( b )

【FIG. 27】
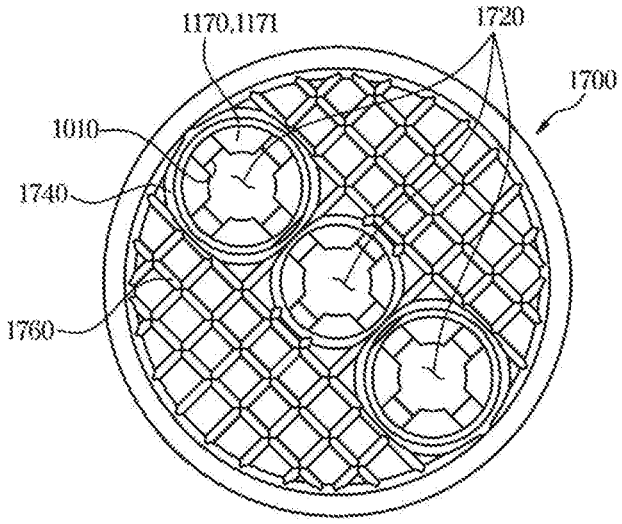
( a )
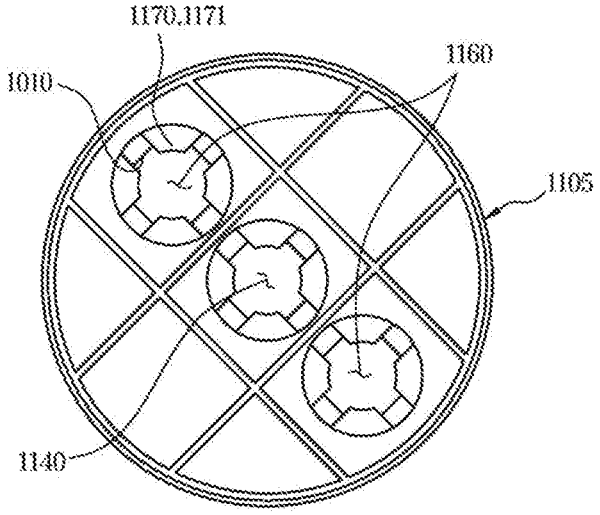
( b )

[FIG. 28]
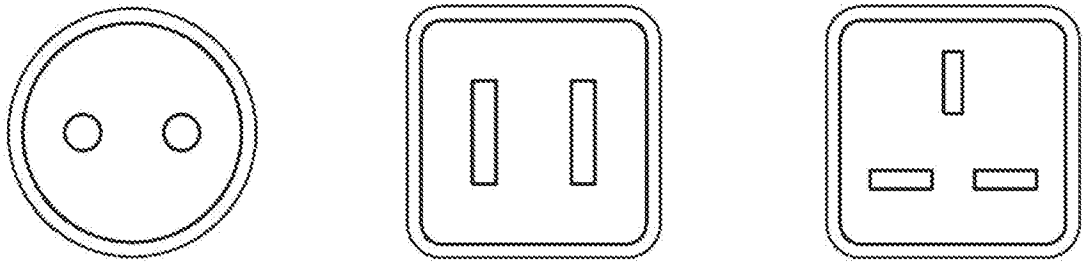

SAFETY OUTLET

TECHNICAL FIELD

The present disclosure relates to a safety outlet, and more particularly, to a safety outlet for energizing only when a plug is inserted, and ensuring sufficient safety by preventing electric shock and short circuit in an inflow of a fluid by a drain pipe separated for each polarity of electricity.

BACKGROUND ART

Generally, in the case of using electricity in an indoor space such as a home or an office, or an external work site, electricity is supplied by inserting a plug into a wall outlet or an outlet provided in a power strip.

The outlets include general outlets used by inserting electrical plugs into inside and outside walls of buildings, ships, trains, and airplanes, and outlets provided with power strips for inserting into electrical plugs.

However, since the outlets are mostly exposed to the outside, various foreign matters may easily enter the inside. That is, when the outlets are used in a place with highly wet or moisture, wet or moisture enters the outlets, resulting in a safety accident such as a short circuit or an electric shock. In addition, there are many cases where the safety accident occurs because a metal object is inserted into a hole into which a pin of the plug is inserted.

Therefore, there is a need for a new concept of safety outlet that may be secured sufficiently.

DISCLOSURE

Technical Problem

The present disclosure is directed to providing a safety outlet for securing a sufficiently safety by energizing only when the plug is inserted.

Furthermore, the present disclosure is directed to providing for preventing short circuit or electric shock by providing with a passage for discharging the fluid introduced into the safety outlet.

Technical Solution

In accordance with one aspect of the present disclosure, a safety outlet includes a casing having at least one hole into which a pin of a plug is inserted; and at least one drain pipe forming a drain channel for independently communicating the at least one hole and the outside of the casing; wherein the drain channel provided in the at least one drain pipe each serves as drain passage separated from each other, and the drain pipe is partitioned so as to maintain sealing between inside of the casing and the drain channel, wherein a contact portion connected to a power terminal arranged outside of the at least one drain pipe is provided in the at least one drain pipe.

Further, the safety outlet may further includes a drain housing coupled to the casing and provided with a drain passage communicating with the drain channel therein; wherein the drain channel is configured to form between an outer surface of the contact portion and an inner surface of the at least one drain pipe.

Further, the power terminal may be provided such that a first electrode strip connected with a power line and a second electrode strip connected with the contact portion are shorted to each other; and the first electrode strip and the second electrode strip are connected by a connection terminal member connected to a driving member moved by the pin of the plug inserted into the contact portion.

Further, the connection terminal member may include a connecting portion connected to the driving member, a guiding portion connected to a center of the connecting portion to guide a vertical movement of the connection terminal member, and a contacting portion extends to both sides of the guiding portion and contact the first electrode strip with the second electrode strip when the guiding portion is moved upward and downward.

Further, the safety outlet may further include an U pipe in which the driving member is provided; wherein one side of the U pipe extends to inside through the drain pipe, and the other side thereof extends to the outside of the drain pipe, and the drain channel is formed between an outer surface of the U pipe and an inner surface of the drain pipe, and the driving member comprises a first push rod supported by a spring arranged on one side of the U pipe to slide upward and downward while maintaining a sealing in the U pipe, a second push rod arranged to maintain the sealing in the other side of the U pipe and connected to the connecting portion of the connection terminal member and movable associated with the first push rod, and a steel wire connecting the first push rod and the second push rod to each other.

Further, the connection terminal member may include a guiding portion supported by a first spring and provided to move upward and downward within a cylindrical boss, a contacting portion extends to both left and right sides of the guiding portion to contact the first electrode strip with the second electrode strip when the guiding portion is lowered, and a connecting rod associated with the driving member, and the driving member comprises a first magnet lowered by the pins of the plug to be inserted and elastically supported by a second spring having a relatively higher elastic force than that of the first spring in the drain pipe, and a second magnet moved together by magnetic force of the first magnet outside the drain pipe and supporting the connecting rod.

In accordance with another aspect of the present disclosure, a safety outlet includes a casing including at least one plug inserting portion into which a plug and a pin of the plug are inserted; and a power terminal provided inside the casing and provided to be electrically connected to the pin of the plug; wherein the power terminal is energized only when the plug and the pins of the plug are inserted into the casing.

Further, the plug inserting portion of the casing may include two plug pin insert holes and a ground hole, and the power terminal is electrically connected to the pins of the plug respectively inserted into the two plug pin insert holes, and configured to a pair of power terminals including a first electrode strip and a second electrode strip shorted to each other, respectively, wherein the safety outlet further comprises a connection terminal member provided to be movable upward and downward in the casing while being supported by a first spring so as to selectively connect the first electrode strip and the second electrode strip; and a driving member associated with the connection terminal member and movable by pins of the plug inserted into the two plug pin insert holes and the ground hole, respectively and provided to move the connection terminal member to energize the first electrode strip and the second electrode strip only when the three pins of the plug are inserted into the two plug pin insert holes and the ground hole.

Further, the connection terminal member may include a guiding portion supported by the first spring to move upward and downward, a contacting portion contacting the first electrode strip and the second electrode strip when the guiding portion is moved, and a connecting rod associated with the driving member.

Further, the driving member may include a first magnet lowered by the pins of the plug to be inserted and elastically supported by a second spring having a relatively higher elastic force than that of the first spring, and a second magnet moved together by magnetic force of the first magnet and supporting the connecting rod.

Further, the driving member may be elastically supported by the second spring having a relatively higher elastic force than that of the first spring to be pressed by the pins of the plug to be inserted, and is provided as a member movable up and down associated with the connection terminal member.

Further, the plug inserting portion of the casing may be provided with a first push hole and a plurality of pinholes, and the safety outlet includes a first block coupled to inside the casing and having a second push hole arranged on a line communicating with the first push hole and a plurality of terminal holes arranged on a line communicating with the plurality of pinholes; a second block provided to be coupled to the first block; and a power supply provided in the second block and connected to the power terminal.

Further, the safety outlet may further include a push button arranged through the first push hole and the second push hole.

Further, the power supply may include a first electrode strip portion and a second electrode strip portion provided on the first block and spaced apart from the first electrode strip portion; when the plug is inserted the second block is slid so that the first electrode strip portion and the second electrode strip portion are in contact with each other to be energized, and when the plug is not inserted the first electrode strip portion and the second electrode strip portion are separated apart each other to be non-energized.

Further, the plurality of pinholes may further include a guiding portion for guiding the pins of the plug to be inserted smoothly, and the guiding portion is provided with a plurality and formed as protruded or recessed from an inner circumference surface of the pinholes, an inflow passage is formed a spaced space between the plurality of the guiding portions, wherein the guiding portion comprises an inclined portion forming such that a contacting area is inclined when the pins of the plug are inserted, and the inclined portion configures to form as protruded or be recessed shape, or configures to only a slope shape without the protruded or recessed shape, wherein the second electrode strip portion forms a recessed drain passage on an inner circumference surface thereof and molded by insert injection together with the first block.

Further, the safety outlet may further include a second rocket portion having one side supported by the first block through a second spring and the other side supporting the second block, wherein the second rocket portion is provided to penetrate a side surface of the second push hole to contact the push button, when the push button is lowered due to the insertion of the plug, the second rocket portion is slid outward of the second push hole, and when the push button is raised due to the non-insertion or removement of the plug, the second rocket portion is slid inward of the second push hole, wherein the second rocket portion is inserted into the guiding portion recessed in the push button, when the push button is lowered due to the insertion of the plug, the second rocket portion is deviated from the guiding portion to slide outward of the second push hole.

Further, the safety outlet may further include a first rocket portion having one side supported by the first block through a first spring and the other side supporting the second block; and a third rocket portion having one side supported by the first block through a third spring and the other side supporting the second block, wherein the first rocket portion and the third rocket portion are provided to penetrate the side surface of the plurality of terminal holes, respectively.

Further, the safety outlet may further include a fourth spring having one side supported by the first block and the other side pressing the second block; wherein each the first, second, and third springs is provided with each elastic force greater than that of the fourth spring.

Further, the safety outlet may further include a drain housing provided in a lower portion of the casing and provided with a discharge passage for discharging the fluid introduced through the first block; and a fifth spring having one side supported by the second drain pipe and the other side provided to press the push button; wherein the drain housing is provided with a plurality of second drain pipes, the plurality of second drain pipes provided to communicate with the first push hole and the plurality of pinholes.

Further, the safety outlet may further include a packing portion installed on the plug insertion portion and made of a soft material; wherein the packing portion comprises a packing hole corresponding to the number of the first push hole and the plurality of pinholes, a packing jaw formed to protrude or be recessed around the packing hole, and at least one partition wall protruding or recessed a predetermined height from an upper surface of the packing portion so as to distinguish the packing holes.

Advantageous Effects

According to the embodiments of the present disclosure, the fluid flowing through a hole formed in a casing of a safety outlet is quickly drained to a drain housing through drain passages for each polarity, thereby preventing short circuit and electric shock so that a safety of the outlet is significantly improved.

In addition, according to the embodiments of the present disclosure, energizing is made only when pins of a plug insert into all three holes of the outlet, thereby preventing the electric shock.

DESCRIPTION OF DRAWINGS

The present disclosure will be described in detail with reference to the following drawings, which illustrate preferred embodiments of the present disclosure, and thus the technical idea of the present disclosure should not be construed as being limited thereto:

FIG. 1 is a perspective view illustrating a safety outlet according to a first embodiment of the present disclosure;

FIG. 2 is an exploded perspective view illustrating the safety outlet according to a first embodiment of the present disclosure;

FIG. 3 is a perspective partial view illustrating the safety outlet according to a first embodiment of the present disclosure;

FIG. 4 is a cross-sectional view taken along line II of FIG. 1;

FIG. 5 is an operation state diagram when a pin of a plug is inserted according to the first embodiment of the present disclosure;

FIG. 6 is a cross-sectional view taken along the line II-II of FIG. 1 according to the first embodiment of the present disclosure;

FIG. 7 is a view illustrating a drain passage of the safety outlet according to the first embodiment of the present disclosure;

FIG. 8 is a perspective view illustrating a configuration of a safety outlet arranged on an upper portion of a drain housing according to a second embodiment of the present disclosure;

FIG. 9 is a perspective partial view illustrating the safety outlet according to the second embodiment of the present disclosure;

FIG. 10 is a cross-sectional view taken along line III-III of FIG. 8;

FIG. 11 is a view illustrating a structure for supporting a connecting portion of a connection terminal member according to the first embodiment of the present disclosure;

FIG. 12 is an operational state diagram of the connection terminal member according to the first embodiment of the present disclosure;

FIG. 13 is a view illustrating holes of various shapes formed in a casing of the present disclosure;

FIG. 14 is a view illustrating a safety outlet in which three pins of the plug are inserted into three holes according to a third embodiment of the present disclosure;

FIG. 15 is a schematic view illustrating a driving member according to the third embodiment of the present disclosure;

FIG. 16 is a block diagram illustrating a plug pin insert hole according to the third embodiment of the present disclosure;

FIG. 17 is a view illustrating coupled state of a safety outlet according to a fourth embodiment of the present disclosure;

FIG. 18 is an exploded perspective view illustrating the safety outlet according to the fourth embodiment of the present disclosure;

FIG. 19 is a view illustrating a state where a first block and a second block are coupled according to a fourth embodiment of the present disclosure;

FIG. 20 is a view illustrating from above a state where a first block and a second block are coupled according to a fourth embodiment of the present disclosure;

FIG. 21 is a view illustrating a terminal hole and a second electrode strip portion according to the fourth embodiment of the present disclosure;

FIG. 22 is a cross-sectional view taken along the line A-A of FIG. 17;

FIG. 23 is a cross-sectional view taken along the line B-B of FIG. 20, and is a state diagram before insertion of the plug;

FIG. 24 is a cross-sectional view taken along the line B-B of FIG. 20, and is a state diagram after insertion of the plug;

FIG. 25 is a view illustrating a drain housing according to the fourth embodiment of the present disclosure;

FIG. 26 is a view illustrating a packing portion and a guiding portion according to the fourth embodiment of the present disclosure;

FIG. 27 is a view illustrating the packing portion and a guiding portion according to another embodiment of the present disclosure; and FIG. 28 is a view illustrating various types of holes formed in the plug inserting portion.

MODES OF THE INVENTION

Hereinafter, the embodiments of the present disclosure will be described in detail with reference to accompanying drawings. It should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation. Therefore, the description proposed herein is just a preferable example for the purpose of illustrations only, not intended to limit the scope of the disclosure, so it should be understood that other equivalents and modifications could be made thereto without departing from the spirit and scope of the disclosure.

FIG. 1 is a perspective view illustrating a safety outlet according to an first embodiment of a present disclosure, FIG. 2 is an exploded perspective view illustrating the safety outlet according to the first embodiment of the present disclosure, FIG. 3 is a partial view illustrating the safety outlet according to the first embodiment of the present disclosure, FIG. 4 is a cross-sectional view taken along line I-I of FIG. 1, FIG. 5 is an operation state diagram illustrating when a pin of a plug is inserted according to the first embodiment of the present disclosure, FIG. 6 is a cross-sectional view taken along line II-II of FIG. 1, and FIG. 7 is a view illustrating a drain passage of the safety outlet according to the first embodiment of the present disclosure.

FIGS. 1 to 7, the safety outlet 10 according to the first embodiment of the present disclosure includes a casing 20 in which a plug pin insert holes 21 is formed so as to insert a pin 11 (see FIG. 5) formed in a plug of a home appliance, and a drain housing 30 coupled to an open lower portion of the casing 20 and having a drain passage 31 for discharging a fluid introduced through the plug pin insert holes 21.

The plug pin insert holes 21 is formed inside a groove 22 recessed in an upper surface of the casing 20. The plug pin insert holes 21 may have a corresponding number depending on a 2-pin or 3-pin types. In addition, a ground hole 23 may be formed on the upper surface of the casing 20 if necessary. In the present embodiment, the ground hole 23 is described as a configuration consisting of a hole in which a push button 78 protrudes.

The groove 22 formed on the upper surface of the casing is covered with a silicon packing 40 to prevent the fluid introduced into the plug pin insert holes 21.

The silicon packing 40 has the number of packing holes 41 corresponding to the holes 21 and 23 formed on the upper surface of the casing 20 and a protruding circular step 42 is provided around the packing holes 41 to prevent an inflow of the fluid.

A partition wall 43 protruding a predetermined height from the upper surface of the silicon packing 40 is formed between the packing holes 41 formed in the silicon packing 40 so as to distinguish the plurality of packing holes 41 such that the fluid introduced around one packing hole 41 may be blocked from flowing to the other packing hole 41.

When the pins of the plug are inserted into the plurality of packing holes 41 formed in the silicon packing 40, a gap between the pins of the plug and the packing holes 41 may be maintained a sealing by a lip 44 provided along an inner circumference of the packing hole 41.

A side surface of the casing 20 may be formed with a cutting hole 29 for draining the fluid introduced into the groove 22 formed on the upper surface of the casing 20 to the outside. The cutting holes 29 may be formed at both side surfaces of the casing 20, and are provided in a shape penetrating from both side surfaces of the casing 20 to an inner side surface of the groove 22.

On a bottom surface 24 of the casing 20, an upper drain pipe 25 may be provided in the form of a boss shape, extending a predetermined length downward from each plug pin insert holes 21 to form an upper portion of a drain channel 13 (see FIG. 7).

The drain channel 13 is a passage that guides the fluid introduced through the plug pin insert holes 21 toward a drain passage 31 formed in the drain housing 30.

The drain housing 30 is formed with the drain passage 31 for discharging the fluid introduced through the plug pin insert holes 21 to the outside.

The drain passage 31 is formed to extend in a longitudinal direction of the drain housing 30, and is connected to communicate with the drain channels 13 connected to each of the plug pin insert holes 21 and the ground hole 23, respectively.

The upper portion of the drain housing 30 is provided with a lower drain pipe 32 for connecting with the upper drain pipe 25.

The holes 21 and 23 communicate with the drain passage 31 through drain passages 13 formed independently of each other by drain pipes 25 and 32 connected to the holes 21 and 23, respectively.

Therefore, the drain passages 13 inside the drain pipes 25 and 32 connected to each of the holes 21 and 23 serve as drain channels separated from each other. Two plug pin insert holes 21 are inserted with pins 11 of the plug contacting power terminal having different polarities, respectively, and the drain pipes 25 and 32 form independent drain passages 13 for each polarity.

The lower drain pipe 32 is provided in the form of an extension pipe 32*a* having an enlarged diameter at the upper end thereof to be fitted to a lower end of the upper drain pipe 25 and the lower end thereof is fitted to a cylindrical coupling boss 33 at the upper surface of the drain housing 30.

When the upper drain pipe 25 and the lower drain pipe 32 are connected to each other, the plug pin insert holes 21 and the drain passages 31 have a structure communicating with the upper drain pipes 25 and the lower drain pipe 32. Herein, the upper drain pipe 25 and the lower drain pipe 32 may be manufactured to form a drain pipe integrally.

An O-ring 26 is installed at a connect portion between the upper drain pipe 25 and the lower drain pipe 32 to maintain sealing.

A contact portion 50 into which the pin 11 of the plug is inserted is provided inside the upper drain pipe 25, and at the contact portion 50 a second electrode strip 52*b* of a power terminal 52 penetrates the upper drain pipe 25 and extends outward.

The contact portion 50 is formed in a hollow cylindrical shape having an upper and lower openings, and on an outer surface of the contact portion 50, an interval rib 51 is formed to form a gap between the upper drain pipe 25 and the contact portion 50 to allow the flow of the fluid.

In addition, the contact portion 50 may be formed in various shapes according to the shape of the pin 11 of the plug.

The interval rib 51 may be provided to face each other at the outer surface of the contact portion 50, and form the gap between the contact portion 50 and the upper drain pipe 25 so that the gap forms part of the drain channel 13 through which the fluid flows.

The power terminal 52 is provided such that a first electrode strip 52*a* connected to a power line and the second electrode strip 52*b* connected to the contact portion 50 are shorted to each other, and the first electrode strip 52*a* and the second electrode strip 52*b* are selectively contacted by a connection terminal member 60.

The power terminal 52 includes a pair in which a positive power terminal and a negative power terminal are faced and spaced apart from each other, and the pair of power terminals 52 each may be energized by an conductor 63*a* of a contacting portion 63 provided in the connection terminal member 60.

The connection terminal member 60 may be moved upward by the pin 11 of the plug inserted through the plug pin insert holes 21 and by the push button 78 pressed and moved by the plug, respectively, by a driving member 70.

The connection terminal member 60 includes a connecting portion 61 connected to the driving member 70, a guiding portion 62 connected to a center of the connecting portion 61 to guide a stable vertical movement of the connection terminal member 60, and a contacting portion 63 extended from both sides of the guiding portion 62 to face the lower portion of the pair of power terminals 52. The contacting portion 63 is positioned on an underside of a separated section between the first and second electrode strips 52*a* and 52*b* of the pair of power terminals 52 to connect the two electrode strips 52*a*, 52*b* when moving upward.

The connecting portion 61 is provided in the form of a flat plate and is positioned on an upper end of a plurality of U pipes 80 in which the driving member 70 is installed. The guiding portion 62 is provided in a cylindrical shape and is positioned to be slidablely moved within a hollow cylindrical boss 64 provided at the upper portion of the drain housing 30.

The contacting portion 63 is provided as a triangular member that extends outward from both sides of the guiding portion 62 and is positioned below the corresponding electrode strips 52*a* and 52*b*.

The conductor 63*a* are provided on two adjacent surfaces at the upper end of the contacting portion 63. As shown in FIG. 5, when the contacting portion 63 moves upward, the conductors 63*a* connect two electrode strips 52*a* and 52*b* which are separated from each other.

The driving member 70 is installed inside the U pipes 80 and moves when pressed by the pin 11 inserting through the plug pin insert holes 21.

One side of the U pipes 80 penetrates through the lower drain pipe 32 and is located in the lower drain pipe 32, and the other side thereof extends to the outside of the lower drain pipe 32.

A predetermined gap is formed between the outer surface of the U pipes 80 inserted into the lower drain pipe 32 and the inner surface of the lower drain pipe 32 to form a part of the drain channel 13 of the fluid introduced through the plug pin insert holes 21.

The driving member 70 includes a first push rod 72 which is supported by a first spring 71 arranged in one side of the U pipes 80 and moves slidably up and down within the lower drain pipe 32, a second push rod 73 which is arranged in the other side of the U pipes 80 and connected to the connecting portion 61 of the connection terminal member 60, and a steel wire 74 connecting the first push rod 72 and the second push rod 73 to move the second push rod 73 when the first push rod 72 moves.

In this embodiment, the steel wire 74 is shown as a configuration for moving the second push rod 73 according to the movement of the first push rod 72, but a medium such as a fluid such as water or air is filled in the U pipes 80 located between the first push rod 72 and the second push rod 73 and may be configured to be moved by using the medium.

The first push rod 72 includes a first body 72*a* which is slidably movable while maintaining sealing at one side of the U pipes 80, and a first rod 72*b* which extends to an upper portion of the first body 72*a* and may be in contact with the pin 11 to be inserted.

An outer circumference of the first body 72*a* is provided with a first O-ring 72*c* for maintaining the sealing between the outer surface of the first body 72*a* and the inner surface of the U pipes 80.

A first cap member 75 is coupled to an upper end of one side of the U pipes 80 to seal an upper opening of the U pipes 80.

O-rings 75*a*, 75*b* are installed in the first cap member 75 for sealing between the inner surface of the U pipes 80 and the outer surface of the first cap member 75, and between the first rod 72*b* and the inner surface of the first cap members 75.

As shown in FIG. 5, when the first push rod 72 is pressed by the pin 11 to be inserted, the first push rod 72 moves downward, and the steel wire 74 presses and moves upward the second push rod 73 located in the other side of the U pipes 80 according to the movement of the first push rod 72.

When external force applied to the first push rod 72 is removed, the first push rod 72 is returned to its original position by elastic force of the first spring 71.

The second push rod 73 includes a second body 73*a* which is slidably movable while maintaining the sealing at the other side of the U pipes 80, and a second rod 73*b* extends to an upper portion of the second body 73*a* and is connected to the connection terminal member 60.

An outer circumference of the second body 73*a* is provided with a second O-ring 73*c* for maintaining the sealing between the outer surface of the second body 73*a* and the inner surface of the U pipes 80.

A second cap member 76 is coupled to an upper end of the other side of the U pipes 80 to seal the upper opening of the U pipes 80.

O-rings 76*a*, 76*b* are installed in the second cap member 76 for sealing between the inner surface of the U pipes 80 and the outer surface of the second cap member 76, and between the second rod 73*b* and the inner surface of the second cap members 76.

When the steel wire 74 presses and moves upward the second push rod 73 located on the other side of the U pipes 80 according to the movement of the first push rod 72, the connection terminal member 60 moves upward together with the movement of the second push rod 73 and then the contacting portion 63 of the connection terminal member 60 contacts the electrode strips 52*a* and 52*b*, thereby energizing therebetween.

A configuration arranged below the ground hole 23 is the same as the configuration arranged below the plug pin insert holes 21, and a configuration for pressing the first push rod 72 is made by a push button 78 provided separately instead of the pin 11 of the plug.

Meanwhile, the cylindrical boss 64 may be provided with a second spring for pressing the guiding portion 62 upwards so that the contacting portion 63 is in close contact with the electrode strips 52*a* and 52*b*.

The second spring is provided to have an elastic force relatively smaller than the elastic force of the first spring 71, the guiding portion 62 is moved downward by the first push rod 72 moving upward by the elastic force of the first spring 71 in the state where no external force is applied to the first push rod 72, so that the contacting portions 63 located at both sides of the guiding portions 62 are spaced apart from the power terminal 52.

Through the above configuration, as shown in FIG. 7, the fluid introduced into the plug pin insert holes 21 falls to the drain passage 31 along the drain channel 13 configured to the gap formed between the upper drain pipe 25 and the contact portion 50 and the gap formed between the lower drain pipe 32 and the U pipe 80, the fluid dropped into the drain passage 31 is discharged to the outside of the drain housing 30.

The drain passages 13 are provided in the holes 21 and 23 provided in the casing 20, respectively, so that the fluid introduced through the holes 21 and 23 falls to the drain passage 31.

Referring to FIG. 6, the drain passage 31 formed in the drain housing 30 may have the number corresponding to the number of holes 21 and 23 formed in the casing 20.

The drain passage 31 includes a central drain passage 31*a* positioned at the center such that the fluid falling from the ground hole 23 flows in and left, and right drain passages 31*b*, 31*c* located on both left and right sides of the central drain passage 31*a* such that the fluid falling from the plug pin insert holes 21 flows in. Each of the drain passages 31*a*, 31*b*, 31*c* is provided to communicate with holes 21, 23 formed in the casing 20, respectively.

Meanwhile, the left and right opposite ends of the drain housing 30 is provided with a receiving space 34 to insert user manual, precautions, after-sales service policy of the outlet.

Hereinafter, the driving member for moving the connection terminal member of the safety outlet according to another embodiment of the present disclosure.

FIG. 8 is a perspective view illustrating a configuration of a safety outlet arranged on an upper portion of a drain housing according to another embodiment of the present disclosure, FIG. 9 is a perspective partial view illustrating the safety outlet according to another embodiment of the present disclosure, FIG. 10 is a cross-sectional view taken along line III-III of FIG. 8, FIG. 11 is a view illustrating a structure for supporting a connecting portion of a connection terminal member according to the one embodiment of the present disclosure, and FIG. 12 is an operational state diagram of the connection terminal member according to the another embodiment of the present disclosure.

Referring to FIGS. 8 to 12, a connection terminal member 100 includes a cylindrical guiding portion 101 provided to move up and down within a hollow cylindrical boss 110, a contacting portion 102 extended from both sides of the guiding portion 101 to face the upper portion of the pair of power terminals 52, and a connecting rod 103 extending out of the guiding portion 101 between the pair of contacting portions 102 to associate with the driving member. The contacting portion 102 is located on an upside of a separated section between the first and second electrode strips 52*a* and 52*b* of the pair of power terminals 52 to contact the two electrode strips 52*a*, 52*b* when moving downward.

The guiding portion 101 is elastically supported in a direction in which the pair of contacting portions 102 are in contact with the electrode strips 52*a* and 52*b* by a first spring 104 disposed thereon.

The contacting portion 102 is formed of an inverted triangular member so as to be engaged with the electrode strips 52*a* and 52*b* positioned at the bottom thereof, and a conductor 102*a* is provided at two adjacent surfaces at the lower end of the contacting portion 102. When the contacting portion 102 moves downward, the conductor 102*a* connects the two electrode strips 52*a* and 52*b* which are separated from each other.

A contact portion 130 is provided inside the drain pipe 120 for contacting the pin 11 to be inserted, and an outer surface of the contact portion 130 is provided with an interval rib 131 to form a drain channel 133 between the contact portion 130 and a drain pipe 120.

The connection terminal member 100 may be provided to be moved downward by the driving member moving by the pin 11 to be inserted.

The driving member includes a first magnet 140 disposed inside the drain pipe 120 and a second magnet 150 disposed outside the drain pipe 120.

A first magnet 140 elastically supported by a second spring 141 is arranged below the contact portion 130 inside the drain pipe 120, and a second magnet 150 movable together with the first magnet 140 is arranged outside the drain pipe 120 by a magnetic force with the first magnet 140.

Herein, the first magnet 140 and the second magnet 150 refers to a member that attracts each other by the magnetic force.

The second spring 141 presses the first magnet 140 upward when no external force is applied. The second spring 141 is provided to have a larger elastic force than that of the first spring 104. Accordingly, the second spring 141 provides the first magnet 140 with a force to move upward the connection terminal member 100 pressed downward by the first spring 104 in a state where no external force is applied, and the connection terminal member 100 is separated from the electrode strips 52*a*, 52*b* by the second magnet 150 moving together with the movement of the first magnet 140.

When the pin 11 enters the plug pin insert holes 21, the first magnet 140 moves downward by the pin 11, and the second magnet 150 is moved downward together by the magnetic force of the first magnet 140.

A connecting portion 103 of the connection terminal member 100 includes three supporting ends 103*a*, 103*b* and 103*c* supported on the second magnets 120 provided on an outer surfaces of the three drain pipes 120, respectively.

Since the connection terminal member 100 is in a state in which the three support ends 103*a*, 103*b*, and 103*c* are supported on the second magnet 120, the connection terminal member 100 does not move downward in the state where all of the second magnets 150 installed in each of the three drain pipes 120 are not moved downward.

Therefore, as shown in FIG. 12, when all of the second magnets 150 installed in each of the three drain pipes 120 move downward, the guiding portion 101 moves downward by the elastic force of the first spring 104 and the contacting portion 102 with the movement of the guiding portion 101 moves downward to contact the two electrode strips 52*a* and 52*b*. According to the configuration shown in FIG. 12, when the pin 11 of the plug consists of two, one of the three holes is configured to press the first magnet 140 by the push button 78 protruding from the ground hole 23 instead of the pin 11 of the plug.

Meanwhile, the driving member for moving the connection terminal member of the safety outlet may be configured as a sensor type. For example, the driving member is provided with a sensor for detecting a position of the pin 11 inserted into the three drain pipes 120 and a solenoid drive device, so that the solenoid drive device moves the connection terminal member in a direction of contact with the power terminal only when all of the three drain pipes 120 are inserted into the three drain pipes 120. The solenoid drive device may be configured to move the connection terminal member by moving a plunger by a magnetic field generated when power is applied to an electric coil.

In addition, the present embodiment discloses a structure in which the connection terminal member may be moved by using the magnet moved by the pins of the plug inserted into three holes or the pins of the plug inserted into two holes and the push button. But, as shown in FIG. 15, the driving member for moving the connection terminal member 100 having three supporting ends may be configured as a separate structure 300 (For example, a member 302 supported by a spring 301 and movable up and down) which is interfered by the pin 11 of the plug without the structure of the drain pipe. That is, according to the present embodiment, three structures 300 are provided to support the three supporting ends of the connection terminal member 100, respectively, and only when the pins of the plug are all inserted thereto and are in contact with the three structures 300, the first electrode strip and the second electrode strip may be energized.

Meanwhile, as shown in FIG. 13, the holes provided in the casing 20 may have a variety of shapes according to the pin shape of the plug provided for each country.

FIG. 14 illustrates a safety outlet provided with three holes 21 and a switch 200 into which three pins of the plug are inserted according to another embodiment of the present disclosure.

As shown in FIG. 14, in the case of the configuration to turn on/off the power by the operation of the switch 200, the flow of the fluid may be blocked through a bellows-shaped housing 210 in the lower structure of the switch 200.

In addition, in the case of the plug is provided with three pins including a ground pin, the above-described configuration of the push button 78 is omitted, and the three pins of the plug may be configured to be operated by the configuration inserted into the three holes 21.

FIG. 16 illustrates a structure of a variable plug pin insert holes according to another embodiment of the present disclosure.

Referring to FIG. 16, a ring groove 330 recessed in an annular shape is formed around the plug pin insert holes 21 and a cylindrical seal member 332 which is movable up and down and supported by a spring 331 provided on an inner side of the ring groove 330 is provided on the ring groove 330.

The cylindrical seal member 332 has a lower end supported by the spring 331, and a locking projection 333 extending inwardly from the lower end thereof is caught by a locking protrusion 334 provided inside the ring groove 330, so that the cylindrical seal member 332 is not separated from the ring groove 330.

When the pin 11 of the plug are inserted into the plug pin insert holes 21, the upper end of the seal member 332 protruding to the upper portion of the ring groove 330 is inserted into a seal member receiving groove 336 formed in a plug 335, thereby maintain the sealing.

Referring to FIGS. 17 to 28, the safety outlet according to the present disclosure includes at least one plug inserting portion 1120. The plug inserting portion 1120 includes a casing 1100 provided with a first push hole 1140 and a plurality of pinholes 1160, a first block 1200 coupled to the inside of the casing 1100 and provided with a second push hole 1240 arranged on a line communicating with the first push hole 1140 and a plurality of terminal holes 1260 arranged on a line communicating with the plurality of pinholes 1160, a second block 1300 slidably coupled to the first block 1200, and a power supply 1500. The power terminal unit 1500 includes a first electrode strip portion 1520 provided in the second block 1300 and connected to the power terminal, and a second electrode strip portion

1540 provided in the first block 1200 and spaced apart from the first electrode strip portion 1520.

The safety outlet of the present disclosure may include a general outlet which is installed in the inner and outer walls of a building or is provided anywhere using electricity such as a vehicle, a passenger ship, a train, an airplane, or other means of transportation, and also may include all of the outlets provided on a power strip used to overcome a limited distance of electricity supply.

The Safety outlet of the present disclosure may include the casing 1100 having the at least one plug inserting portion 1120. The casing 1100 includes both a form of being buried or exposed to any place using electricity, such as a building or a transportation means, and a form of a power strip housing. The plug inserting portion 1120 may be provided in the shape of grooves (or holes) recessed as shown in FIG. 1, or alternatively, may be provided in a shape not recessed.

The plug inserting portion 1120 may provide a space in which the plug and pins of the plug may be inserted. The plug inserting portion 1120 includes the first push hole 1140 in which a push button 1400 to be described later is arranged, and the plurality of pinholes 1160 into which the pins of the plug is inserted.

Meanwhile, the first push hole 1140, the plurality of pinholes 1160, and a plurality of first drain pipes 1110 are provided in a body portion 1105 provided separately from the casing 1100 as shown in drawings to be coupled or inserted into the plug inserting portion 1120. However, according to the outlet shape of each country, the casing 1100 and the body portion 1105 may be configured as an integrated rather than a separate configuration. The present disclosure includes both a case where the body portion 1105 is provided in a separate configuration from the casing 1100 and a case where the body portion 1105 is integrally provided.

In the drawings of the present specification, a case in which two pinholes 1160 are provided for a two-pin type plug is shown, but the present disclosure may also include a case in which three pinholes 1160 are provided for a three-pin type plug. In the case of the 3-pin type plug, the first push hole 1140 may serve as the pinholes 1160, and the second push hole 1240, which will be described later, serves as the terminal holes 1260, and a power connection terminal is provided in the terminal hole so that a total of three pinholes may be available for use as ground hole or three-phase outlet. On the other hand, as shown in FIG. 28, the holes of the plug inserting portion 1120 may have various shapes according to the plug shape of each country.

In addition, a side surface of the casing 1100 may be formed with a cutting hole 1130 for draining the fluid introduced into the plug inserting portion 1120 to the outside. The cutting hole 1130 may be formed at both side surfaces of the casing 1100 or slopes of the casing 1100, and may be provided in a shape penetrating from both side surfaces of the casing 1100 to an inner surface of the plug inserting portion 1120. And, in the casing 1100, the plurality of first drain pipes 1110 extending a predetermined length downward from the first push hole 1140 and the plurality of pinholes 1160 may be provided.

The first block 1200 is coupled to the inside of the casing 1100, and includes the second push hole 1240 arranged on a line communicating with the first push hole 1140 and the plurality of pinholes 1160 arranged on a line communicating with the plurality of terminal holes 1260.

Specifically, the first block 1200 may be fitted or coupled to the first drain pipes 1110 of the casing 1100. The second push hole 1240 of the first block 1200 is arranged on a line communicating with the first push hole 1140 described above, and the push button 1400 described later is installed. The plurality of terminal holes 1260 of the first block 1200 may be provided in the number corresponding to the plurality of pinholes 1160 and arranged on a line communicating with the plurality of pinholes 1160. Accordingly, when the plug is inserted, the pins of the plug are inserted into the pinholes 1160 of the casing 1100 and then inserted into the terminal holes 1260 of the first block 1200.

The second electrode strip portion 1540 to be described later may be inserted into or coupled to the plurality of terminal holes 1260. When the pins of the plug are inserted into the terminal holes 1260, the plug may contact the second electrode strip portion 1540 provided in the terminal holes 1260. The second electrode strip portion 1540 is in contact with the first electrode strip portion 1520 connected to the power terminal described later and may be energized.

In addition, the second block 1300 may be slidably coupled to the first block 1200. Specifically, as shown in FIGS. 18 and 19, the first block 1200 may be provided with a first rail 1220 recessed from the side to the inside or protruded from the side to the outside, and the second block 1300 may be provided with a second rail 1320 having a shape that protrudes or recesses into a shape corresponding to the first rail 1220. Accordingly, the second rail 1320 of the second block 1300 may be inserted into and coupled to the first rail 1220 of the first block 1200 or the first rail 1320 of the first block 1200 may be inserted into and coupled to the second rail 1320 of the second block 1300. As a result, the second block 1300 may be provided to slide along the first rail 1220 of the first block 1200. As shown in FIGS. 2 and 3, the first rail 1220 has a recessed shape and the second rail 1320 has a protruded flange shape, but the present disclosure may include the first rail 1220 has a protruded flange shape and the second rail 1320 has a recessed shape.

Additionally, the power supply 1500 may include the first electrode strip portion 1520 and the second electrode strip portion 1540. The first electrode strip portion 1520 may be provided in the second block 1300 and connected to the power line. The second electrode strip portion 1540 may be provided in the first block 1200 and provided to be spaced apart from the first electrode strip portion 1520.

Accordingly, when the plug and the pins of the plug are inserted into the plug inserting portion 1120, the second block 1300 is slid, and the first electrode strip portion 1520 of the second block 1300 and the second electrode strip portion 1540 of the first block 1200 are contacted, thereby energizing therebetween.

In addition, the safety outlet of the present disclosure may further include the push button 1400 arranged on penetrating the first push hole 1140 and the second push hole 1240. When the plug is inserted into the plug inserting portion 1120, the push button 1400 may be slid downward to press a second rocket portion R2 described later. And, when the plug is inserted, the pins of the plug may press first and third rocket portions R1 and R3 described later. Accordingly, when all of the first, second, and third rocket portions R1, R2, and R3 are pressed, a space in which the second block 1300 may be slid is formed, and as the second block 1300 is slid, the first electrode strip portion 1520 and the second electrode strip portion 1540 may be in contact with each other.

Particularly, when the plug is inserted, the power supply 1500 allows the second block 1300 to be slid so that the first electrode strip portion 1520 and the second electrode strip portion 1540 are in contact with each other to be energized. When the plug is not inserted, the first electrode strip portion 1520 and the second electrode strip portion 1540 are separated apart from each other to be non-energized.

In other words, the safety outlet of the present disclosure is provided such that the first electrode strip portion 1520 and the second electrode strip portion 1540 of the power supply 1500 are in contact with each other to be energized, only when the plug is inserted into the plug inserting portion 1120. Therefore, when a foreign material of a metallic material is inserted into the pinholes 1160 and the terminal holes 1260, the first electrode strip portion 1520 and the second electrode strip portion 1540 are separated from each other and in a non-contact state so that the electric shock or the short circuit may be prevented.

In addition, the safety outlet of the present disclosure may further include a guiding portion 1170 for guiding the plurality of pinholes 1160 to smoothly insert the pins of the plug. The guiding portion 1170 may be provided to be integrally formed with the pinholes 1160 as shown, or may be provided separately from the pinholes 1160 to be fitted to the inner circumference surface of the pinholes 1160.

Meanwhile, the guiding portion 1170 may be formed in various shapes such as an embossed shape or an intaglio shape as shown in FIGS. 26 and 27. That is, the guiding portion 1170 may be provided in a protruding flange shape having a thin thickness on the inner circumference surface of the pinholes 1160 as shown in FIG. 26 or may be provided in a protruding flange shape having a predetermined thickness as shown in FIG. 27.

Additionally, the guiding portion 1170 is provided with a plurality and may be provided to protrude or be recessed from the inner circumference surface of the pinholes 1160, and the plurality of guiding portions 1170 may be provided to be spaced apart from each other. Since the guiding portions 1170 are spaced apart from each other, an inflow passage 1010 through which the introduced fluid is flowed may be formed in the spaced space. Therefore, the fluid introduced into the plug inserting portion 1120 may be led to the lower side of the casing 1100 through the inflow passage 1010. The inflow passage 1010 may be connected to a drain passage 1020 described later and to led the fluid introduced to a drain housing 1600.

In addition, the guiding portion 1170 may include an inclined portion 1171 formed so as to incline a contacting area when the pins of the plug are inserted. The inclined portion 1171 may be provided on an upper portion of the guiding portion 1170, and may be formed such that the pins of the plug are smoothly guided inwardly at the contacting area when the pins of the plug are inserted. The inclined portion 1171 may have a shape in which the shape of the guiding portion 1170 extends to the inclined portion 1171 and protrudes or recesses, or may be formed of only a slope without a protruding or recessed shape. In addition, the first push hole 1140 is also formed such that the upper portion thereof is inclined such as the inclined portion 1171 of the guiding portion 1170, so that the pins of the plug are smoothly guided inwardly at the area where the pins of the plug contact.

The second electrode strip portion 1540 is provided to be fitted into the terminal holes 1260. When the second electrode strip portion 1540 is fitted into the terminal holes 1260, an interval space between the inner circumference surface of the terminal holes 1260 and the outer circumference surface of the second electrode strip portion 1540 may be formed the drain passage 1020. That is, the drain passage 1020 is formed between the inner circumference surface of the terminal holes 1260 and the outer circumference surface of the second electrode strip portion 1540, thereby inducing the fluid introduced to the drain housing 1600 described later.

The upper and lower portions of drain passage 1020 may communicate with the inflow passage 1010 described above and a discharge passage 1640 of the drain housing 1600 described later, respectively. In addition, the fluid introduced into the plug inserting portion 1120 is primarily drained to the outside of the casing 1100 through the cutting hole 1130, and the fluid introduced into the plurality of pinholes 1160 is drained to the outside of the casing 1100 after passing through the inflow passage 1010, the drain passage 1020, and the discharge passage 1640.

Moreover, the second electrode strip portion 1540 may be molded by insert injection together the first block 1200. That is, since the second electrode strip portion 1540 is integrally molded when the first block 1200 is molded, coupling rigidity of the terminal holes 1260 of the first block 1200 and the second electrode strip portion 1540 may be sufficiently secured. On the other hand, in this case, the drain passage formed recessed may be formed on the inner circumference surface of the second electrode strip portion 1540, thereby inducing the fluid introduced through the drain passage to the drain housing side.

Meanwhile, the safety outlet of the present disclosure may further include the second rocket portion R2, one side of the second rocket portion R2 is supported by the first block 1200 through a second spring S2 and the other side thereof supports the second block 1300.

Particularly, the second rocket portion R2 is provided to penetrate a side surface of the second push hole 1240 to be in contact with the push button 1400, and when the push button 1400 is lowered due to the insertion of the plug the second rocket portion R2 may be slid outward of the second push hole 1240, and when the push button 1400 is raised due to the non-insertion or removement of the plug the second rocket portion R2 may be slid inward of the second push hole 1240.

In addition, the second rocket portion R2 is inserted into a guiding portion 1420 formed of a recessed shape in the push button 1400, and when the push button 1400 is lowered due to the insertion of the plug the second rocket portion R2 may be deviated from the guiding portion 1420 and may be slid outward of the second push hole 1240.

Accordingly, when the push button is lowered, the second rocket portion R2 is deviated from the guiding portion 1420 and simultaneously is slid outward of the second push hole 1240, and the second rocket portion R2 presses the second spring S2 to be compressed. Whereas, when the push button 1400 is raised again, the second spring S2 press the second rocket R2 so that the second rocket R2 may be slid inward of the second push hole 1240.

Moreover, the safety outlet of the present disclosure may further include the first and third rocket portions R1 and R3, one side of the first rocket portion is supported by the first block 1200 through a first spring S1 and the other side thereof supporting the second block 1300, and one side of the third rocket portion R3 is supported by the first block 1200 through a third spring S3 and the other side thereof supporting the second block 1300. The first rocket portion R1 and the third rocket portion R3 may be provided to penetrate the side surfaces of the plurality of terminal holes 1260, respectively.

Specifically, a penetrating portion is formed on side surface of the plurality of terminal holes 1260, and the first and third rocket portions R1 and R3 may be inserted into the penetrating portion. When the pins of the plug are inserted, the first and third rocket portions R1 and R3 are pressed by the pins of the plug to compress the first and third springs S1 and S3 and are slid outward of the terminal holes 1260. And, when the pins of the plug are non-inserted or removed, the first and third rocket portions R1 and R3 may be slid inward of the terminal holes by the first and third springs S and S3.

Meanwhile, according to the safety outlet of the present disclosure, the sealing member A may be provided in the first, second, and third rocket portions R1, R2, and R3 as shown in FIGS. 2, 7, and 8. That is, when the sealing is required, the sealing member A may be provided between the penetrating portion formed in the first block 1200 and the first, second, and third rocket portions R1, R2, and R3 so that the first, second, and third rocket portions R1, R2, and R3 may be inserted into the first block 1200. The sealing member A may be made of an elastic material such as rubber, and may be provided in the shape of an O-ring. Accordingly, the sealing member A may maintain the sealing so that the fluid introduced into the second push hole 1240 and the plurality of terminal holes 1260 is not leak to the first, second, third springs S1, S2, S3 side through the penetration portion into which the first, second and third rocket portions R1, R2 and R3 of the first block 1200 are inserted. The sealing member A can be kept airtight so that it may not leak to the 1st, 2nd, 3rd spring S1, S2, S3 side. In other words, when the penetrating portion needs the sealing, it is possible to maintain the sealing between the penetrating portion and the first, second, and third rocket portions R1, R2, and R3 through the sealing member A.

Moreover, the safety outlet of the present disclosure may further include a fourth spring S4, one side of the fourth spring is supported by the first block 1200 and the other side thereof presses the second block 1300. Particularly, one side of the fourth spring S4 is supported by the first block 1200 and the other side thereof may be interposed between the first block 1200 and the second block 1300 to press the second block 1300. Therefore, when a space in which the second block 1300 is slid is formed, the fourth spring S4 may press the second block 1300 to be slid. In this case, the second electrode strip portion 1540 of the first block 1200 and the first electrode strip portion 1520 of the second block 1300 may be in contact with each other to be electrically connected.

Meanwhile, each of the first, second, and third springs S1, S2, and S3 may have greater elastic force than that of the fourth spring S4. Therefore, when one of the first, second, and third springs S1, S2, and S3 is not compressed, the space in which the second block 1300 may be slid is not formed, so that the second block 1300 may not be slid even when the fourth spring S4 presses the second block 1300.

In addition, according to the safety outlet of the present disclosure, when the plug is inserted, the push button 1400 is lowered, and the second rocket portion R2 is slid outward of the second push hole 1240 to press the second spring S2, and the first and third rocket portions R1 and R3 are slid outward of the plurality of terminal holes 1260 by the pins of the plug to press the first and third springs S and S3, and the fourth spring S4 may press the second block 1300 to be slid. Therefore, when the second block 1300 is slid, the first electrode strip portion 1520 and the second electrode strip portion 1540 may be in contact with each other to be electrically connected.

In other words, the safety outlet of the present disclosure may slide the second block 1300 only when the push button 1400 is lowered and simultaneously an object is inserted into the plurality of pinholes 1160 and the terminal holes 1260 to slide the first, second, and third rocket portions R1, R2, and R3 simultaneously.

Therefore, when only the push button 1400 is lowered, the second rocket portion R2 is slid outward of the second push hole 1240 but the first and third rocket portions R1 and R3 do not be slid, so that the second block 1300 may not be slid. Further, even when an object is inserted into one pinhole 1160 and the terminal holes 1260 and an object is inserted into the plurality of pinholes 1160 and the terminal hole 1260, the second block 1300 may not be slid because the second rocket portion R2 does not be slid unless the push button 1400 is lowered together. Therefore, even when a foreign material or chopsticks made of metal material are inserted into the plurality of pinholes 1160 and the terminal holes 1260, the first electrode strip portion 1520 and the second electrode strip portion 1540 are not in contact with each other, thereby preventing electric shock and short circuit.

Moreover, the safety outlet of the present disclosure may further include the drain housing 1600 provided below the casing 1100 and provided with the discharge passage for discharging the fluid introduced through the first block 1200. The drain housing 1600 may include a plurality of second drain pipes 1620, and the plurality of second drain pipes 1620 may have a pipe shape to communicate with the first push hole 1140 and the plurality of the pinholes 1160. Accordingly, the fluid introduced into the plug inserting portion 1120 of the casing 1100 passes through the inflow passage 1010 and the drain passage 1020, and then may be induced into the discharge passage 1640 through the second drain pipes 1620 to discharge toward the outside of the safety outlet through a discharge port 1641 formed in the drain housing 1600.

In addition, the safety outlet of the present disclosure may further include a fifth spring S5, one side of the fifth spring S5 is supported by the second drain pipes 1620 and the other side thereof presses the push button 1400. That is, one side of the fifth spring S5 may be supported by a protrusion 1621 formed in the second drain pipes 1620 of the drain housing 1600 and the other side of the fifth spring S5 may be arranged to press the push button 1400. Accordingly, when the push button 1400 is lowered due to the insertion of the plug, the fifth spring S5 is compressed, and when the plug is non-insertion or removement, the fifth spring S5 presses the push button 1400 and slides upward the push button 1400.

FIG. 26 is a view illustrating a packing portion and a guiding portion according to another embodiment of the present disclosure, and FIG. 27 is a view illustrating a packing portion and a guiding portion according to another embodiment of the present disclosure. FIGS. 26 and 27*a* are views illustrating the packing portion and the guiding portion together, and FIG. 27*b* is a view illustrating the guiding portion without the packing portion placed thereon.

The safety outlet of the present disclosure may be provided to have a soft packing portion 1700. The packing portion 1700 may be provided with a soft elastic body such as rubber or silicone material. The packing portion 1700 is mounted on the plug inserting portion 1120 of the casing 1100. In addition, the packing portion 1700 may be provided with the number of packing holes 1720 corresponding to the first push hole 1140 and the plurality of pinholes 1160 of the casing 1100. A packing jaw 1740 protruding or recessed may be formed around the packing holes 1720. The packing jaw 1740 may be provided in a circular shape as shown, alternatively may be provided in a square or other various shapes. Therefore, the fluid introduced into the plug inserting portion 1120 of the casing 1100 may be prevented from flowing into the first push hole 1140 and the plurality of pinholes 1160 by the packing jaw 1740. In addition, the packing portion 1700 may be provided with at least one partition wall 1760 formed to protrude or recess a predetermined height so as to distinguish a space between the pluralities of packing holes 1720. Therefore, the fluid introduced around one packing hole 1720 may be prevented from flowing into the others packing holes 1720. The partition wall 1760 may have a shape as illustrated in FIGS. 26 and 27, but may be implemented in various shapes corresponding to plug shapes of each countries. Although the packing jaw 1740 and the partition wall 1760 are illustrated to protrude on the drawings of the present disclosure, the present disclosure is not limited thereto and may include one provided in the shape of a recessed portion.

According to the safety outlet of the present disclosure, the fluid introduced into the plug inserting portion 1120 may be primarily discharged to the outside through the cutting hole 1130 of the casing 1100. The fluid introduced into the first push hole 1140 and the plurality of pinholes 1160 is induced to the drain housing 1600 through the inflow passage 1010 and the drain passage 1020 and the discharge passage 1640, and the fluid induced to the drain passage 1600 may be discharged to the outside of the safety outlet through the discharge port 1641.

The safety outlet of the present disclosure is provided such that the first electrode strip portion 1520 and the second electrode strip portion 1540 are in contact with each other and energized therebetween, only when the plug and the pins of the plug are inserted into the plug inserting portion 1120. Therefore, when only the push button 1400 is lowered, the first electrode strip portion 1520 and the second electrode strip portion 1540 are not in contact with each other. In addition, when the push button 1400 is not lowered even when an object is inserted into the plurality of pinholes 1160 and the terminal holes 1260, the first electrode strip portion 1520 and the second electrode strip portion 1540 are not in contact with each other.

Therefore, the safety outlet of the present disclosure may be smoothly discharged the fluid introduced to the outside of the casing, and the electricity may be energized only when the plug is fully inserted, thereby sufficiently preventing electric shock and short circuit.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A safety outlet, comprising:

a casing having at least one hole into which a pin of a plug is inserted; and at least one drain pipe forming a drain channel for independently communicating the at least one hole and the outside of the casing;

wherein the drain channel provided in the at least one drain pipe each serves as drain passage separated from each other, and the drain pipe is partitioned so as to maintain a sealing between inside of the casing and the drain channel, wherein a contact portion connected to a power terminal arranged outside of the at least one drain pipe is provided in the at least one pipe.

2. The safety outlet of claim 1, further comprising:

a drain housing coupled to the casing and provided with a drain passage communicating with the drain channel therein;

wherein the drain channel is configured to form between an outer surface of the contact portion and an inner surface of the at least one drain pipe.

3. The safety outlet of claim 2, wherein the power terminal is provided such that a first electrode strip connected with a power line and a second electrode strip connected with the contact portion are shorted to each other; and the first electrode strip and the second electrode strip are connected by a connection terminal member connected to a driving member moved by the pin of the plug inserted into the contact portion.

4. The safety outlet of claim 3, wherein the connection terminal member comprises a connecting portion connected to the driving member, a guiding portion connected to a center of the connecting portion to guide a vertical movement of the connection terminal member, and a contacting portion extends to both sides of the guiding portion and contact the first electrode strip with the second electrode when the guiding portion is moved upward and downward.

5. The safety outlet of claim 4, further comprising:

an U pipe in which the driving member is provided wherein one side of the U pipe extends to inside through the drain pipe, and the other side thereof extends to the outside of the drain pipe, and the drain channel is formed between an outer surface of the U pipe and an inner surface of the drain pipe, and the driving member comprises a first push rod supported by a spring arranged on one side of the U pipe to slide upward and downward while maintaining a sealing in the U pipe, a second push rod arranged to maintain the sealing in the other side of the U pipe and connected to the connecting portion of the connection terminal member and movable associated with the first push rod, and a steel wire connecting the first push rod and the second push rod to each other.

6. The safety outlet of claim 3, wherein the connection terminal member comprises a guiding portion supported by a first spring and provided to move upward and downward within a cylindrical boss, a contacting portion extends to both left and right sides of the guiding portion to contact the first electrode strip with the second electrode strip when the guiding portion is lowered, and a connecting rod associated with the driving member, and the driving member comprises a first magnet lowered by the pins of the plug to be inserted and elastically supported by a second spring having a relatively higher elastic force than that of the first spring in the drain pipe, and a second magnet moved together by magnetic force of the first magnet outside the drain pipe and supporting the connecting rod.

7. The safety outlet comprising:

a casing including at least one plug inserting portion into which a plug and a pin of the plug may be inserted; and a power terminal provided inside the casing and provided to be electrically connected to the pin of the plug;

wherein the power terminal is energized only when the plug and pins of the plug are inserted into the casing wherein the plug inserting portion of the casing comprises two plug pin insert holes and a ground hole, and the power terminal is electrically connected to the pins of the plug respectively inserted into the two plug pin insert holes, and configured to a pair of power terminals including a first electrode strip and a second electrode strip shorted to each other, respectively, wherein the safety outlet further comprises a connection terminal member provided to be movable upward and downward in the casing while being supported by a first spring so as to selectively connect the first electrode strip and the second electrode strip; and a driving member associated with the connection terminal member and movable by pins of the plug inserted into the two plug pin insert holes and the ground hole, respectively and provided to move the connection terminal member to energize the first electrode strip and the second electrode strip only when the three pins of the plug are inserted into the two plug pin insert holes and the ground hole.

8. The safety outlet of claim 7, wherein the connection terminal member comprises a guiding portion supported by the first spring to move upward and downward, a contacting portion contacting the first electrode strip and the second electrode strip when the guiding portion is moved, and a connecting rod associated with the driving member.

9. The safety outlet of claim 8, wherein the driving member comprises a first magnet lowered by the pins of the plug to be inserted and elastically supported by a second spring having a relatively higher elastic force than that of the first spring, and a second magnet moved together by magnetic force of the first magnet and supporting the connecting rod.

10. The safety outlet of claim 8, wherein the driving member is elastically supported by the second spring having a relatively higher elastic force than that of the first spring to be pressed by the pins of the plug to be inserted, and is provided as a member movable up and down associated with the connection terminal member.

11. A safety outlet, comprising a casing including at least one plug inserting portion into which a plug and a pin of the plug may be inserted;

a power terminal provided inside the casing and provided to be electrically connected to the pin of the plug;

wherein the power terminal is energized only when the plug and the pins of the plug are inserted into the casing, wherein the plug inserting portion of the casing is provided with a first push hole and a plurality of pinholes, and the safety outlet comprises:

a first block coupled to inside the casing and having a second push hole arranged on a line communicating with the first push hole and a plurality of terminal holes arranged on a line communicating with the plurality of pinholes;

a second block provided to be coupled to the first block; and a power supply provided in the second block and connected to the power terminal.

12. The safety outlet of claim 11, further comprising:

a push button arranged through the push hole and the second push hole.

13. The safety outlet of claim 11 wherein the power supply includes a first electrode strip portion and a second electrode portion provided on the first block and spaced apart from the first electrode strip portion;

when the plug is inserted the second block is slid so that the first electrode strip portion and the second electrode strip portion are in contact with each other to be energized, and when the plug is not inserted the first electrode strip portion and the second electrode strip portion are separated apart each other to be non-energized.

14. The safety outlet of claim 13 wherein the plurality of pinholes further comprises a guiding portion for guiding the pins of the plug to be inserted smoothly, and the guiding portion is provided with a plurality and formed as protruded or recessed an inner circumference surface of the pinholes, an inflow passage is formed a spaced space between the plurality of the guiding portions, wherein the guiding portion comprises an inclined portion forming such that a contacting area is inclined when the pins of the plug are inserted, and the inclined portion configures to form as protruded or be recessed shape, or configures to only a slope shape without the protruded or recessed shape, wherein the second electrode strip portion forms a recessed drain passage on an inner circumference surface thereof and molded by insert injection together with the first block.

15. The safety outlet of claim 12, further comprising:

a second rocket portion having one side supported by the first block through a second spring and the other side supporting the second block, wherein the second rocket portion is provided to penetrate a side surface of the second push hole to contact the push button, when the push button is lowered due to the insertion of the plug, the second rocket portion is slid outward of the second push hole, and when the push button is raised due to the non-insertion or removement of the plug, the second rocket portion is slid inward of the second push hole, wherein the second rocket portion is inserted into the guiding portion recessed in the push button, when the push button is lowered due to the insertion of the plug, the second rocket portion is deviated from the guiding portion to slide outward of the second push hole.

16. The safety outlet of claim 15, further comprising a first rocket portion having one side supported by the first block through a first spring and the other side supporting the second block; and a third rocket portion having one side by the first block through a third spring and the other side supporting the second block;

wherein the first rocket portion and the third rocket portion are provided to penetrate the side surface of the plurality of terminal holes, respectively.

17. The safety outlet of claim 16, further comprising:

a fourth spring having one side supported by the first block and the other side pressing the second block;

wherein each the first, second, and third springs is provided with each elastic force greater than that of the fourth spring.

18. The safety outlet of claim 12, further comprising:

a drain housing provided in a lower portion of the casing and provided with a discharge passage for discharging the fluid introduced through the first block; and a fifth spring having one side supported by the second drain pipe and the other side provided to press the push button;

wherein the drain housing is provided with a plurality of second drain pipes, the plurality of second drain pipes provided to communicate with the first push hole and the plurality of pinholes.

19. The safety outlet of claim 11, further comprising:

a packing portion installed on the plug insertion portion and made of a soft material;

wherein the packing portion comprises a packing hole corresponding to the number of the first push hole and the plurality of pinholes, a packing jaw formed to protrude or be recessed around the packing hole, and at least one partition wall protruding or recessed a predetermined height from an upper surface of the packing portion so as to distinguish the packing holes.

* * * * *